US007980755B2

(12) United States Patent
Renfro

(10) Patent No.: US 7,980,755 B2
(45) Date of Patent: Jul. 19, 2011

(54) METHOD FOR MIXING ADDITIVE INTO VISCOUS MATERIAL

(76) Inventor: Charles K. Renfro, Elizabethton, TN (US)

( * ) Notice: Subject to any disclaimer, the term of this patent is extended or adjusted under 35 U.S.C. 154(b) by 1142 days.

(21) Appl. No.: 11/710,803

(22) Filed: Feb. 26, 2007

(65) Prior Publication Data

US 2007/0177455 A1 Aug. 2, 2007

Related U.S. Application Data

(63) Continuation-in-part of application No. 10/845,551, filed on May 13, 2004, now abandoned, which is a continuation-in-part of application No. 10/115,330, filed on Apr. 2, 2002, now Pat. No. 7,070,318, which is a continuation-in-part of application No. 09/563,465, filed on May 2, 2000, now abandoned, application No. 11/710,803, which is a continuation-in-part of application No. 10/293,850, filed on Nov. 14, 2002, now Pat. No. 6,910,799.

(51) Int. Cl.
*B01F 3/10* (2006.01)

(52) U.S. Cl. ..... 366/255; 366/247

(58) Field of Classification Search ..... 366/129, 366/168.1, 169.1, 207, 243, 251, 255, 289, 366/331, 348
See application file for complete search history.

(56) References Cited

U.S. PATENT DOCUMENTS

| | | | | |
|---|---|---|---|---|
| 1,998,692 | A * | 4/1935 | Van Rossem et al. | 366/333 |
| 3,195,778 | A * | 7/1965 | Coates | 222/80 |
| 3,858,853 | A * | 1/1975 | Rausch et al. | 366/279 |
| 6,910,799 | B2 * | 6/2005 | Renfro | 366/169.1 |
| 7,070,318 | B2 * | 7/2006 | Renfro | 366/143 |
| 7,407,321 | B1 * | 8/2008 | Renfro | 366/256 |
| 2002/0154568 | A1 * | 10/2002 | Renfro | 366/169.1 |
| 2003/0099153 | A1 * | 5/2003 | Renfro | 366/169.1 |
| 2004/0173640 | A1 * | 9/2004 | Brandon | 222/327 |

* cited by examiner

*Primary Examiner* — David L Sorkin

(74) *Attorney, Agent, or Firm* — Luedeka, Neely & Graham, P.C.

(57) ABSTRACT

A mixing apparatus having a mixing impeller affixed to the end of a mixer shaft which is reciprocably and rotatably or non-rotatably mounted thru mixer seal structure which has surface portions adapted to be brought into sealing engagement with the open filler end of a retail off-the-shelf tube of viscous caulking or sealant compound or the like, wherein the shaft and impeller are adapted to be reciprocated thru the compound and an additive contained in the tube substantially the entire length of the tube to rapidly and intimately mix the compound with colorant or other additive added directly into the retail tube thru its filler (back) end.

4 Claims, 13 Drawing Sheets

"MD"
"UD"

63
20a
22a
30a
24a
46a
40a 28a
42a
50a
29a
8a
26a
2a
58
14a
44a
45a
60
25a

48a 32a
34a
36a
38

METHOD FOR MIXING ADDITIVE INTO VISCOUS MATERIAL

This application is a continuation-in-part of application Ser. No. 10/845,551 filed May 13, 2004 now abandoned which is a continuation-in-part of application Ser. No. 10/115,330, filed Apr. 2, 2002, now U.S. Pat. No. 7,070,318, which is a continuation-in-part of application Ser. No. 09/563,465, filed May 2, 2000, now abandoned; this application is also a continuation-in-part of pending application Ser. No. 10/845,551 filed May 13, 2004 now abandoned which is a continuation-in-part of application Ser. No. 10/293,850, filed Nov. 14, 2002, now U.S. Pat. No. 6,910,799 which is a continuation-in-part of application Ser. No. 10/115,330, filed Apr. 2, 2002, now U.S. Pat. No. 7,070,318, which is a continuation-in-part of application Ser. No. 09/563,465, filed May 2, 2000, now abandoned; and this application also claims priority to Provisional Application Ser. No. 60/859,697 filed on Nov. 18, 2006, entitled Mixing Device For Coloring An Off-The-Shelf Caulk Tube.

BACKGROUND OF THE INVENTION

1. Field

This invention concerns a method and apparatus for mixing any of a wide variety of liquid or particulate materials such as colorant, e.g., pigment or organic dye, sand, grout, catalyst for two part caulking, or adhesive, or the like preferably in solution or suspension form, into viscous work material, particularly any of a variety of chemically composed base materials of caulking or sealing compound which may already be colored, or clear or white, and which may be used for caulking any structures, wherein the structural components of the apparatus are of unique but simple design and are adapted to accomplish the mixing very rapidly and directly within the work material retail container, i.e., in-situ if so desired.

The word "caulk" as used herein encompasses air drying as well as catalyst curing sealant, adhesive beading and bordering, or insulating caulk or grout, or the like material, including polyurethane construction adhesive, acrylic/silicone latex caulk adhesive, painters white ($CaCo_3$) latex caulk, elastomeric latex sealant, and the like, any of which can be clear, white or partially colored, and used on wood, ceramic, metal, plastic, etc., for all purposes. The initial caulk can be flat, glossy, satin, etc., and the present method can modify the appearance and sheen thereof by mixing in various additives.

In the use of certain materials such as caulking or other sealing materials which are sold in plastic dispensing tubes such as "DAP® Acrylic Latex Caulk Plus Silicone", it is often desirable to color the material to match, e.g., the wall color being applied to a room. For example, in the use of conventional white caulking material, as soon as the material sets up sufficiently, usually about two hours or longer, the material can be painted the same color as the room. Where the paint is of a light shade in particular, it may be difficult to cover the material completely without multiple paint coats. Also, it is often necessary to do some additional caulking after the final coat of paint has been applied. In that event, the white caulking has to be painted over as the final step. Consequently, some paint dealers have undertaken to mix colorant into the caulking material by hand for certain customers, but considerable time and effort is involved and often results in inferior mixing and considerable clean up time.

The present invention provides a quick, effective, convenient and cleaner method and apparatus for substantially automatically performing the mixing operation.

2. Prior Art

Applicant is unaware of any prior apparatus or method of the type disclosed and claimed herein which is designed to mix colorant directly into caulking compound or the like contained in its retail tube.

SUMMARY OF THE INVENTION

The present invention, in one of its preferred embodiments comprises a mixer head means having a mixer shaft rotatably or non-rotatably mounted axially therethrough and having a mixing impeller or blade means affixed to a distal end thereof, a proximal end of said shaft being adapted for engagement with a power source, e.g., mechanical, pneumatic, hydraulic, or preferably by hand, for reciprocating said shaft and impeller means axially and rotationally if desired, said head means having a first annular sealing surface adapted for making a sealing connection to a second annular sealing surface on an open filler end portion of a tube of viscous caulking composition or the like whereby the combination of said head means and tube is completely portable and independent of other structure, and wherein said shaft with said mixing impeller or blade means is adapted to be reciprocated thru the viscous composition contained in the tube substantially the entire length of the tube to rapidly and intimately mix the composition with colorant or other additive material placed in the tube.

In certain preferred embodiments:

(a) the blade means is provided at its periphery with a wiping surface adapted to longitudinally and rotatably if desired, slide in a wiping action against or in close proximity to the inner surface of the tube whereby no significant amount of unmixed compound, colorant or other additive remains;

(b) a colorant supply means is provided to inject the colorant into the compound during reciprocation of the shaft and blade means thru the compound;

(c) the supply means of (b) above comprises passage means extending longitudinally thru the shaft whereby colorant can be either pressure injected or gravity fed at a desired rate therethrough into the compound either before or during rotation and/or longitudinal mixing movement of the shaft thru the compound;

(d) the shaft with mixer blade means is reciprocably mounted, and if desired also rotatably mounted and supported on power means in a longitudinally stationary position wherein mixer head means is provided for holding the tube filler end and wherein linear power means is provided for longitudinally reciprocating said head means and tube relative to the shaft and mixer blade means;

(e) power means is provided for selectively reversing rotation of the shaft and blade means during the mixing operation to afford maximum mixing turbulence to the compound;

(f) said head means includes rotative power means connected to said proximal end of said shaft for rotating said shaft;

(g) said head means is provided with structure for connecting it to an apparatus which can reciprocate the head and tube relative to said shaft and impeller; and (h) a vibration means is provided to vibrate at least the tube during and/or after mixing to settle the composition toward the dispensing end of the tube.

The present mixing method in one preferred embodiment employing a retail, off-the-shelf tube of caulking material wherein the tube has a puncturably sealed dispenser end section, a filler end section having surface portions defining a fill opening into the tube, a thrust cap or back plug sealingly, slidably mounted in said filler end section, and further employing a mixer head means adapted to seal against said surface portions of said filler end section during the mixing operation, wherein said head means has mixer shaft means non-rotatably or rotatably and axially slidably mounted therethrough, and wherein a mixer impeller means is fixed to a distal end of said mixer shaft means for axial movement therewith, said method comprising the steps of (a) removing said thrust cap from said tube, (b) adding additive into said tube, (c) connecting said head means to and sealingly against said surface portions of said filler end section to seal said fill opening with said impeller means inside of said tube and to provide a portable hand supportable, independent combination of said head means and tube, (d) starting relative reciprocation and also rotation if desired, of said mixer shaft means within said tube and continuing the reciprocation for a desired mixing period, (e) removing said tube with the colored material therein from said shaft, impeller means and head means, and (f) replacing said thrust cap in said filler end section to retain the mixed material and additive in said tube until use.

Another embodiment includes a method for mixing additive into viscous base material, which base material is contained in a cylindrical tube having a longitudinal axial dimension, a filler end sealed with a removable back plug which has been pushed into said filler end, and further having a dispensing end sealed with a puncturable seal, said tube providing a mixing cavity for said base material and additive, said method comprising; a) removing said back plug from said filler end of said tube, b) adding a measured amount of additive into said cavity thru said filler end to provide a batch for mixing, c) providing a mixing device having a mixer head adapted to be affixed onto said filler end of said tube and hermetically seal said cavity at said filler end, said device further having a mixer shaft having a mixing end portion provided with an apertured impeller affixed to said end portion for reciprocation therewith and adapted to extend into said cavity said shaft further having an operating end portion adapted to extend axially outwardly of said tube and to be engaged by hand or machine for reciprocating said shaft, said shaft being axially reciprocably mounted through a hermetic seal affixed in an aperture provided thru said mixer head; d) inserting said mixing end portion of said shaft with said impeller down into said cavity and into said batch to a desired initial longitudinal position in said cavity; e) affixing said mixer head onto said filler end to hermetically seal said cavity; and f) reciprocating said shaft with said impeller within said cavity between said filler end and said dispensing end whereby said additive is intimately mixed into said base material wherein said filler end of said tube is sealed and said tube is postured with the dispensing end facing generally downwardly and is vibrated after the mixing operation to aid in settling said mass toward said dispensing end whereby de-aeration of said mass is further facilitated. In one version of this embodiment, the filler end of said tube is sealed and said tube is postured with the dispensing end facing generally downwardly and is vibrated in a vertical and/or horizontal direction at from about 1/32 in. to about 3/8 in. travel, at between 100 and 600 cycles/minute for between about five seconds and about three minutes, after the mixing operation to aid in settling said mass toward said dispensing end whereby de-aeration of said mass is further facilitated.

Yet another embodiment includes a method for mixing additive into viscous base material, which base material is contained in a cylindrical tube having a longitudinal axial dimension, a filler end sealed with a removable back plug which has been pushed into said filler end, and further having a dispensing end sealed with a puncturable seal, said tube providing a mixing cavity for said base material and additive, said method comprising; a) removing said back plug from said filler end of said tube, b) adding a measured amount of additive into said cavity thru said filler end to provide a batch for mixing, c) providing a mixing device having a mixer head adapted to be affixed onto said filler end of said tube and hermetically seal said cavity at said filler end, said device further having a mixer shaft having a mixing end portion provided with an apertured impeller affixed to said end portion for reciprocation therewith and adapted to extend into said cavity said shaft further having an operating end portion adapted to extend axially outwardly of said tube and to be engaged by hand or machine for reciprocating said shaft, said shaft being axially reciprocably mounted through a hermetic seal affixed in an aperture provided thru said mixer head; d) inserting said mixing end portion of said shaft with said impeller down into said cavity and into said batch to a desired initial longitudinal position in said cavity; e) affixing said mixer head onto said filler end to hermetically seal said cavity; and f) reciprocating said shaft with said impeller within said cavity between said filler end and said dispensing end whereby said additive is intimately mixed into said base material wherein said filler end of said tube is sealed and said tube is centrifuged toward said dispensing end after the mixing operation to aid in settling said mass toward said dispensing end whereby de-aeration of said mass is further facilitated. In one version, the filler end of said tube is sealed and said tube centrifuged toward said dispensing end after the mixing operation for about 20 seconds to about 3 minutes at of from about 60 rpm to about 400 rpm at a spin radius of from about 12 in. to about 24 in. for accommodating various length tubes, to aid in settling said mass toward said dispensing end whereby de-aeration of said mass is further facilitated.

The types and chemical compositions of the materials which can be mixed in situ in a caulk type tube having a filler end with a removable back plug or thrust cap, in accordance with the present invention is practically unlimited. For example, the base material such as caulk can be acrylic, silicone, epoxy or the like, or mixtures thereof, and may be initially clear, white, putty color or partially colored, or the base material can be part of a curable adhesive system such as epoxy resin. The additive may be colorant, curing agent, filler such as sand or clay for changing texture, e.g., of caulk, grout or other base material. The tube itself can be clear such that the progress of mixing, e.g., color can be readily observed.

The tube size and its composition and structure can be widely varied since the present mixing device can easily be manufactured in different sizes. The tube can be specially manufactured to accommodate different or unusual materials. The dispensing end, however, of any tailor made tube should have a puncturable seal such as a metal foil adhesive seal or light metal cap seal or plastic seal, or the like, i.e., item 141 in the drawings such that the dispensing nozzle does not become filled with unmixed material.

BRIEF DESCRIPTION OF THE DRAWINGS

The invention will be further understood from the following description and drawings herein wherein the structures depicted are not drawn to scale or actual relative proportions and wherein portions thereof are enlarged, cross-sectioned or broken away for clarity, wherein.

DETAILED DESCRIPTION OF THE DRAWINGS

Figure 1:
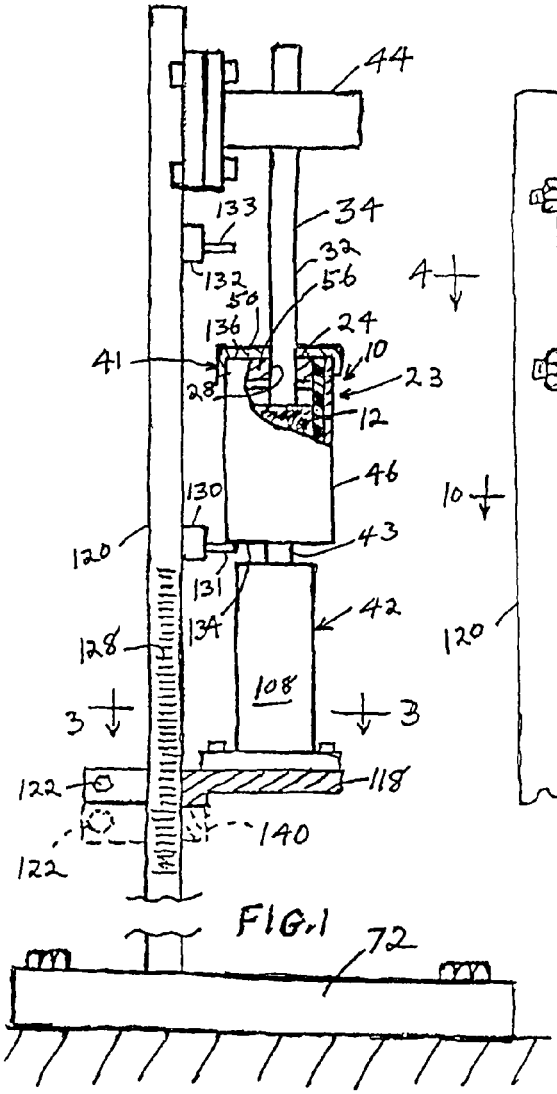
FIG. 1 is a partially sectioned schematic view of an overall mixer apparatus including a fluid, air or hydraulic cylinder for reciprocating any of the mixing head means disclosed herein with caulking tube attached.

Referring to the drawings and with particular reference to the claims hereof, the present apparatus in one preferred form and generally designated 10 is well adapted for mixing liquid, solid or suspension colorant or other material with viscous work material 12 such as caulk which is contained in a reservoir or mixing cavity 14 of an elongated tube 16, typically of plastic, between a puncturably sealed dispensing end 18 and a filler end 20 normally sealed by a thrust cap seal such as 17. The reservoir is provided by a cylindrical inner surface 22 of the tube and has a substantially uniform diameter throughout its length. One typical caulk tube size is approximately 1⅞ in. O.D. and 8½ in., long.

With reference to all of the embodiments shown herein the apparatus in its generic sense comprises mixer head means of metal or plastic material and generally designated 23 having a tube end seal means generally designated 24 adapted to be brought into static engagement by pressure cap means generally designated 41 with wall portions such as the top rim 26 or the upper portions 27 of the interior or outer surfaces of the filler end 20 of the tube to prevent leakage of the work material from the tube during the mixing operation. Bore means 28 is formed thru the tube seal means 24 substantially on a longitudinal axis 30 of the tube, and an elongated mixer shaft means 32 is mounted thru 28 for axial reciprocation, with or without rotational motion with respect to the seal means 24 and tube 16. This shaft means has a proximal end 34 lying axially outwardly of the seal means and has a distal end 36 adapted to lie within the reservoir 14 of the tube. Mixer impeller means 38 is mounted on said distal end and has a periphery 40 adapted to lie closely adjacent to or in sliding contact with cylindrical inner surface 22 of the tube. The above seal means 24, bore means 28, shaft means 32, impeller means 38 and pressure cap means 41 constitute the basic structure of the mixer head means 23.

Power means such as 42 is provided for axially moving, in a relative sense, shaft means 32 and impeller 38 substantially completely thru the reservoir 14 of material in a reciprocating manner, and power means such as 44 is provided for rotating the shaft 32 and impeller 38, if such rotation is desired, as they are being moved axially thru the material.

Figure 2:
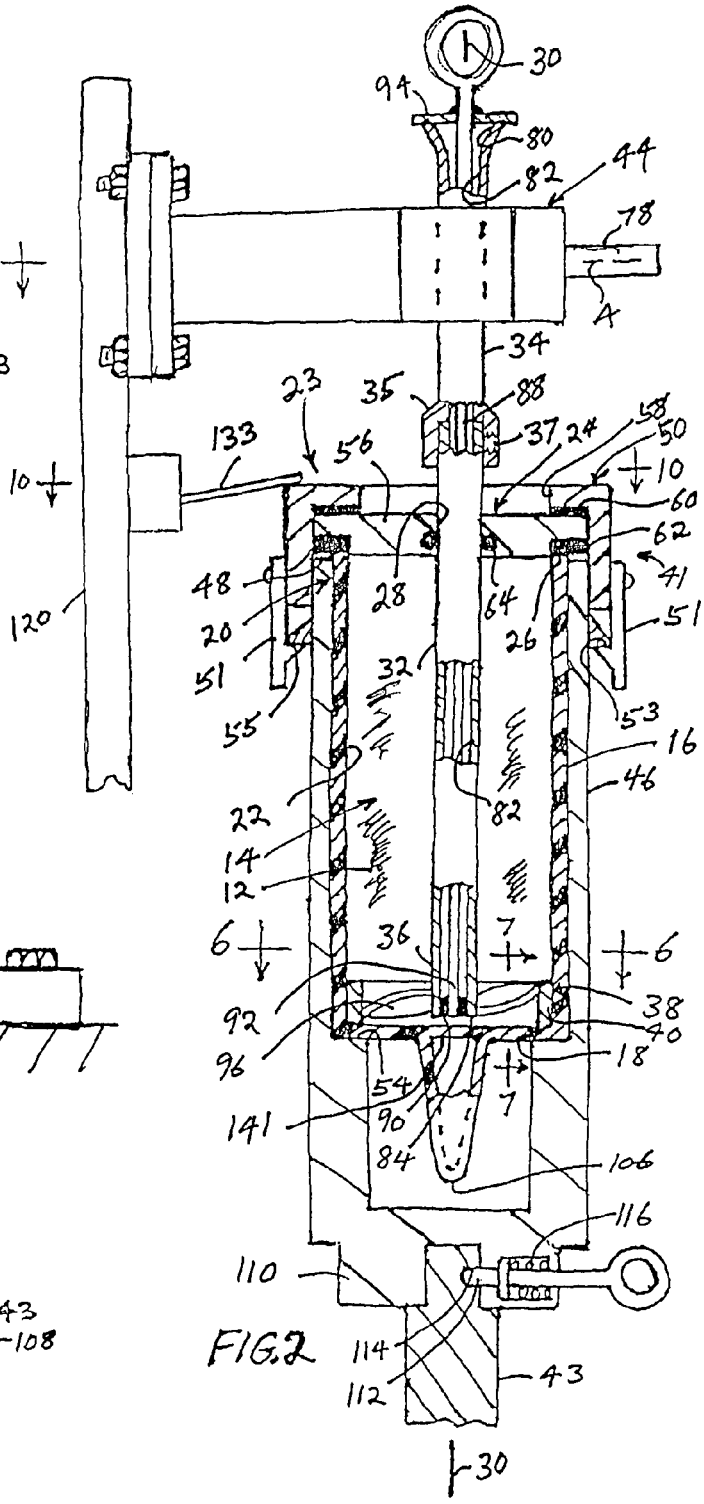
FIG. 2 is a longitudinal partial cross-sectional view of one preferred type of mixing head means for carrying out the present mixing operation wherein the head means and tube are in the up position and wherein the head means has just tripped the top limit switch to reverse the hydraulic cylinder stroke.

In the embodiment shown in FIGS. 1 and 2 the pressure cap means 41 comprises a cylindrical holder section 46 and a pressure cap section 50. The caulking tube is dropped, dispensing end 18 first, with a loose fit between the holder section and tube to allow easy removal of the tube after mixing. In the embodiment of FIG. 2, the top rim 26 of the tube preferably extends slightly above the top rim 48 of the holder section whereby when a pressure cap section 50 is forced down onto the seal means 24, the seal means will seal the tube filler end 20 and said cap section will clamp the ends 20 and 18 of the tube between the seal 24 and a circular ledge 54 on the holder section interior wall. This clamping will prevent rotation of the tube during the mixing operation wherein rotation of the mixer impeller and compound tends to drag the tube into rotation.

Figure 11:
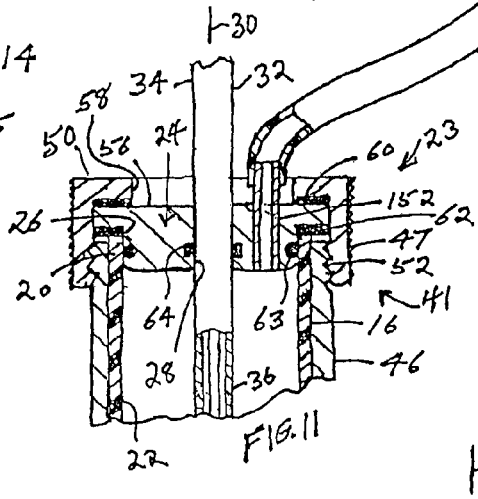
FIG. 11 is a view of the mixer head means on the tube filler end as in FIG. 2 showing a hand held variation of the colorant injection means.

In the embodiment of FIG. 11 a special type of tube end seal means is shown wherein the seal body 56 thereof can be glass, preferably tempered and tough, or clear plastic, and the pressure cap section 50 is formed with a large opening 58 such as to afford a visual inspection of the progress and extent of the colorant mixing operation. An annular cushion 60 of elastomeric material, preferably silicone lubricated, is provided, but not essential, and which, in cooperation with annular elastomeric seal ring 62 cushions the seal body 56. It is noted that where glass is not used, cushion 60 still has utility in providing a slippery surface to facilitate tightening of cap section 50 where threads are employed as shown in FIG. 11, without tending to rotate the seal body 56 and seal ring 62. One or more additional seals such as O-rings 63 may be mounted on 56 if needed.

Shaft means 32 is rotatably mounted thru seal body 56 in all of the embodiments shown, which body is preferably provided with a mixer shaft seal 64 such as an O-ring or other annular ring type seal of composition and configuration which affords an axially sliding seal as well as one which wipes the viscous material from the shaft during reciprocating of the caulking tube.

Figure 4:
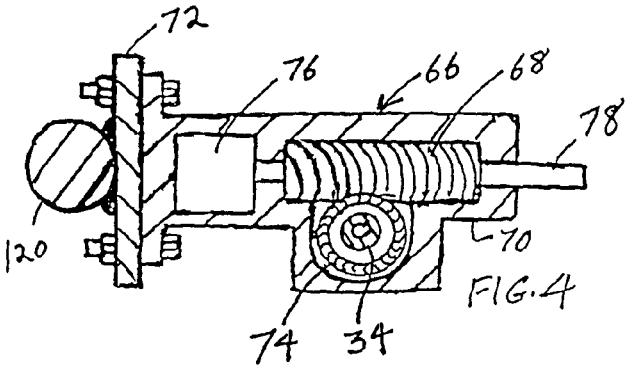
FIG. 4 is a top view of one useful type of worm gear transmission power means for driving the mixing shaft means taken along line 4-4 of FIG. 2, with the gear housing top removed for clarity.
Figure 5:
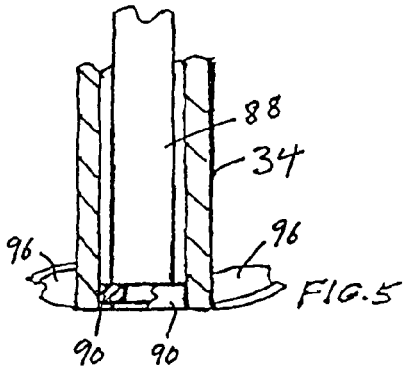
FIG. 5 is an enlarged, for clarity, distal end portion of the mixing blade means and colorant injector piston of FIG. 2.
Figure 8:
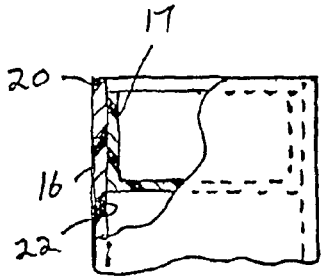
FIG. 8 is a view of the filler end of a typical off-the-shelf caulking compound tube such as DAP® with portions broken away to show the thrust cap in place and which, when pressured further into the tube (down in FIG. 8) by a caulking gun, forces the compound out thru the dispenser nozzle of the tube.

The upper or proximal end 34 of the shaft, in one embodiment is mounted thru a rotative power means 44 which can rotate the shaft 32 selectively and substantially instantly in either direction and at any desired rpm, e.g. 600-800 rpm, such that maximum mixing turbulence can be imparted to the work material. One preferred power means is shown in FIG. 4 as a worm gear transmission 66 having a worm shaft 68 rotatably mounted in a housing 70 affixed to a base or frame means 72 of any desired construction which supports the structural components of the present apparatus. Shaft 32 is affixed to a worm gear 74 which mates with shaft 68 and is rotatable thereby. Shaft 68 may be driven by an electric motor 76, preferably variable speed, or by, e.g., reversible electric hand held drill or the like, either house current or battery powered, with its chuck coupled to shaft extension 78, or by a hand crank coupled to 78, all such shaft rotating means being termed herein as power means.

The outermost end 80 of shaft 32 preferably is funnel shaped for facilitating the loading of colorant into passage 82 which is generally axially provided thru shaft 32 and exits thru the inner end 84 of 32. A colorant injection piston rod 88 and annular seal ring 90 affixed to the inner end portion 92 thereof is slidable down into passage 82 and may be employed to forcibly eject colorant which has been loaded into passage 82, into the work material. Rod 88 is preferably provided with a stop means such as collar 94 affixed thereto to allow ring 90 to substantially completely wipe passage 82 clear of colorant but not to allow 90 to pass beyond end 84 of 32 and become damaged. Shaft portion 34 is preferably split and provided with a socket 35 and set screw 37 to allow removal of the shaft from 44 for facilitating cleaning or replacement with a different size impeller blade means 38 and seal means 24.

Figure 6:
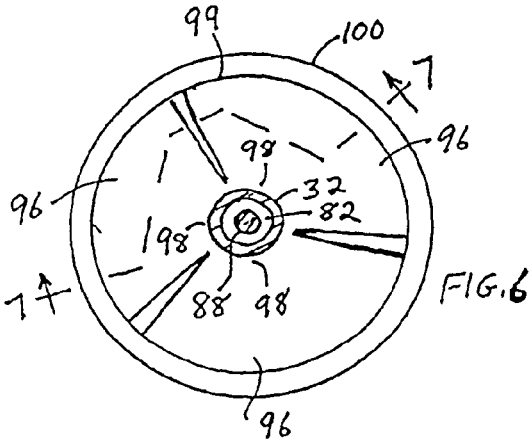
FIG. 6 is a cross-sectional view taken along line 6-6 of FIG. 2 in the direction of the arrows and showing the mixer blade means.
Figure 7:
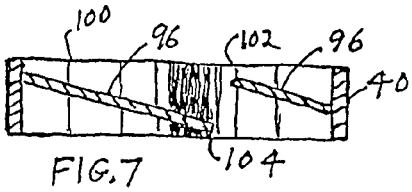
FIG. 7 is a cross-sectional view taken along line 7-7 in FIG. 6 in the direction of the arrows.
Figure 10:
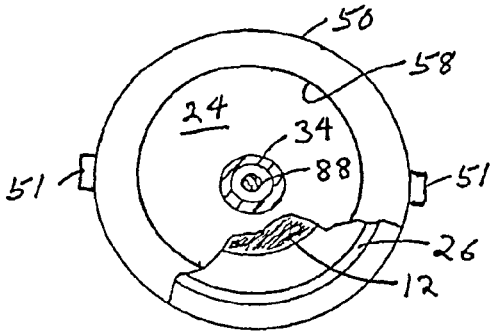
FIG. 10 is a view of the mixer head means taken along line 10-10 of FIG. 2 in the direction of the arrows with portions broken away for clarity.

The mixer impeller or blade means 38 preferably has multiple, e.g., 2-5 blades 96 of any desired shape such as shown in FIGS. 6 and 7 and having their radially inner portions 98 affixed to shaft means 32 and their outer radial portions 99 affixed to cylindrical rim 100. This rim provides peripheral surface 40 which functions to smoothly slide on inner surface 22 of the tube rotationally and linearly to stabilize 32 and 38 and to wipe surface 22 of compound and colorant during the mixing operation. Rim 100 preferably extends slightly above the blades 96 at their upper portions 102 and slightly below the blades at their lower portions 104 such that at the ends of the reciprocation travel, rim 100 will, in the event said travel is slightly unintentionally over extended, engage dispensing end 18 or seal means 24 before the rotating blades can make contact with either or both of 18 or 24 and cause damage thereto or to the blades. It is noted that end 18 is typically of thin plastic such that an Operator can easily puncture it with a nail or the like pushed thru the opened nozzle tip 106 when ready for use.

Figure 3:
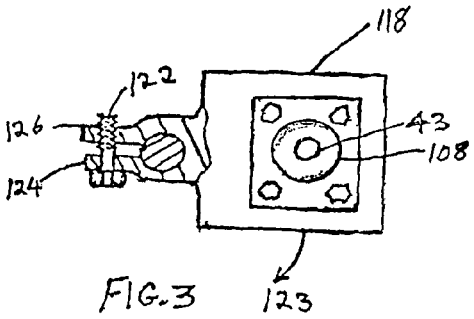
FIG. 3 is a view taken along line 3-3 of FIG. 1 in the direction of the arrows with portions broken away for clarity.

Referring to FIGS. 1-3, the power or lift means 42 preferably is the piston 43 and an automatically two way operating hydraulic or air cylinder 108, and is connected to the base 110 of the holder 46 preferably by a quick disconnect coupling such as pin 112 and socket 114. Compression spring 116 urges pin 112 into 114. Such a coupling allows a quick change of holder 46 to accommodate tubes of different sizes.

In this embodiment, cylinder 108 is mounted on a foot member 118 which is clamped to a stanchion 120 of base or frame means 72 by bolt means 122 slidable thru an aperture in leg 124 and threaded thru a threaded aperture in leg 126. When 122 is loosened, member 118 and attached cylinder 108 and holder 46 can be rotated to the side to allow easy removal or loading of a tube in holder 46. Member 118 can also be slid up or down on stanchion 120 to position holder 46 in the precise vertical position to receive a tube. In this regard, ruler markings 128 can be provided on the stanchion to make easier the proper vertical positioning of 118 for each size tube.

It is apparent that for this embodiment, where tubes of different lengths are used, the travel of piston 43 must be adjusted to give the proper reciprocating stroke length to holder 46, relative to the vertically stationary mixer impeller 38. For this purpose, a cylinder 108 is selected which can readily give the maximum piston stroke required for the longest retail caulking tube which might be used by tradesmen. At the time of this writing about 12 to 14 inches of piston stroke would appear to be more than is needed for the most common reservoir length of retailed tubes of caulking material.

In order to adjust and control the piston stroke length and direction, electrical limit switches 130 and 132 vertically adjustably mounted on frame 72 are adapted to engage their arms 131 and 133 respectively with the bottom 134 and top 136 respectively of holder 46 at the prescribed limits of its reciprocation and, by means of solenoid valves in the hydraulic or air system which are electrically connected to the switches, reverse the direction of hydraulic or air fluid flow and the direction of the piston stroke. Control means are also provided to adjust the speed of the piston reciprocation. In practice, a stroke speed of from about 4 to about 20 seconds per complete up-and-down cycle is desirable, but slower or faster speeds may, of course, be used.

In the operation of the apparatus, a holder 46 of proper dimensions for receiving a particular size caulking tube is connected to piston 43. Foot member 118 is vertically adjusted on stanchion 120 to vertically position the holder where the piston stroke can accommodate the required full up-and-down travel of the holder with room to spare such that impeller 38 can be extracted from the tube after mixing is complete. The limit switches 130, 132 are then vertically adjusted on stanchion 120 of frame 72 and locked into position for being actuated by the bottom and top alternately of the holder at the precise moment that impeller 38 is at the prescribed ends of its reciprocation stroke or travel. The device is now ready to receive a caulking tube 16 from which a thrust cap seal 17 has been removed by, e.g., applying pressure to the tube sides which pops 17 out of the tube.

In order to facilitate vertical loading of the tube into the holder and removing it therefrom, the foot member 118, after loosening bolt 122, is swung to the side 123 such that the holder and tube can clear impeller 38 and any other structure of the device which might be in the way. When it is desirable to maintain the precise vertical position of 118 such as when the device is needed to mix several tubes of the same size, a positioning collar 140 as shown by dotted line in FIG. 1 may be employed to support 118 while it is being rotated.

Figure 9:
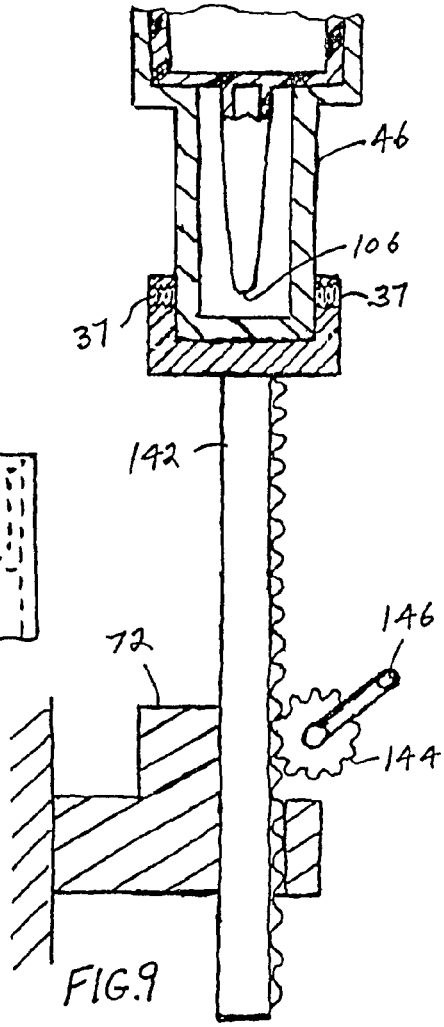
FIG. 9 is a side view, partially sectioned, of a rack and pinion type power means for reciprocating the tube.

As shown in FIG. 9 other types of reciprocating power means may be employed such as rack 142 and pinion gear 144 wherein 144 may be driven by reversible motor means and the travel of 142 controlled by switches such as 130 and 132. Gear 144 may also be fitted within a hand crank 146 if desired.

In the embodiment of FIG. 11, the colorant fluid may be contained in a syringe 148 and a plastic tube 149 provided and connecting the syringe nozzle 150 to a pipe 152 fixed thru the seal body 56. The syringe can be used to inject colorant into the tube before the mixing starts or during the mixing, or both.

In a related embodiment, tube 149 may be rigid or semi-rigid plastic, or metal or ceramic and used, e.g., by inserting it down into the open caulk tube and substantially all the way thru the work material, and the syringe then actuated to inject the colorant into the material as tube 149 is slowly withdrawn therefrom to leave a column of colorant longitudinally in the material. The mixer head means 23 may then be fixed into the open tube end by, e.g., the mechanism of FIG. 13, and the mixing process started by any power means such as a hand drill chucked directly onto shaft portion 34.

It is noted that the configuration of the head means 23, the seal means 24 and the pressure cap means 41 can be varied in accordance with the present invention, such as, for example those shown in FIGS. 2, 11-15 and 20. In FIG. 2, cap section 50 is provided with two or more spring arms 51 which are formed with shoulders 53 adapted to snap in under a shoulder ring 55 affixed around holder 46 as cap section 50 is pushed down over the open neck of the holder with sufficient force to compress seal 62 to a sealing condition. These arms 51 are readily removed from 55 by an outward pull on their lower ends.

In FIG. 11, cap section 50 and the holder section 46 are provided with mating threads 52 such that adequate sealing pressure can be applied to 62 by a small rotating force applied to the cap. Cap section 50 is preferably knurled as at 47 for allowing hand tightening.

Figure 12:
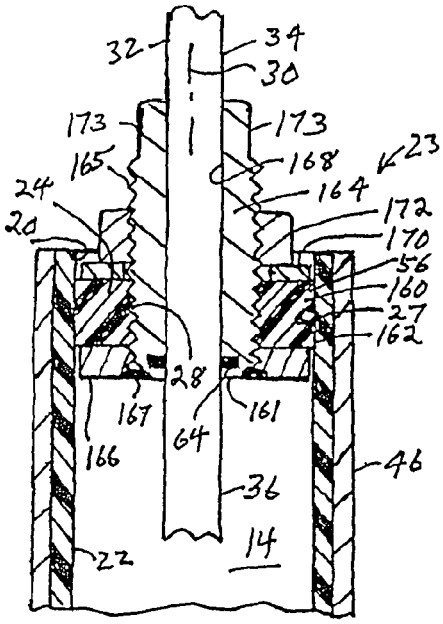
FIG. 12 is a cross-sectional view of the proximal end of the tube and a variation of the mixing head means including a tube holder section.

In FIG. 12 the seal means 24 comprises an elastomeric gripping body, e.g., natural or synthetic rubber, 160 having a circular periphery 162 which is dimensioned in diameter to slide down into the filler end 20 of a caulking tube. A bushing 164 having threads or first shoulder means 165 is axially mounted thru bore 28 in body 160 and has its inner or distal end 161 non-rotatably fixed to a plate 166 or second shoulder means as by welding at 167 or integrally machined or otherwise formed on the bushing as in FIG. 31. Shaft 32 is rotatably, slidably mounted thru a bore 168 in the bushing A washer 170 preferably of low friction metal or plastic material is mounted over the bushing and a nut 172 is threaded over the bushing. The upper end 171 of bushing 164 extends an exaggerated amount above nut 172 to provide wrench flats 173 for holding 164 and body 160 from rotating as nut 172 is tightened against washer 170.

In use, shaft 32 is mounted thru bore 168 with the mixer impeller lying adjacent plate or second shoulder means 166. With the mixer impeller then inserted into a tube thru the tube filler end thereof, body 160 is slid into the filler end to a desired position therein. A wrench is then mounted on flats 173 to hold bushing 164 and washer 166 stationary, and nut 172 is tightened sufficiently to bulge the body 160 radially outwardly to seal and grip against inner surface 22 of the caulking tube. The elastomeric material of body 160 is selected to allow it to sealingly bulge under just a few pounds of pressure from the tightening nut 172.

With the seal means 24 and mixer impeller means thus positioned in the tube, and with the colorant injected, e.g., deposited in the tube, on or into the work material by drop bottles, syringe, spatula, gel capsules, color packets, mechanical dispenser, or the like, the tube can be hand held or placed within a holder or carriage 77, and the shaft 32 rotated either by a power means such as 44 or, e.g., an electric drill having its chuck fixed to 32. In situations where only reciprocation of the mixer impeller thru the work material relative to the caulking tube is desired, such reciprocation can be done by power means such as 42 or by hand.

Figure 14:
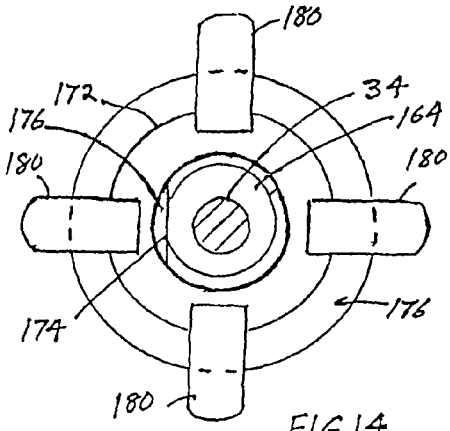
FIG. 14 is a top view of the head means of FIG. 13 taken along line 14-14 thereof in the direction of the arrows.
Figure 15:
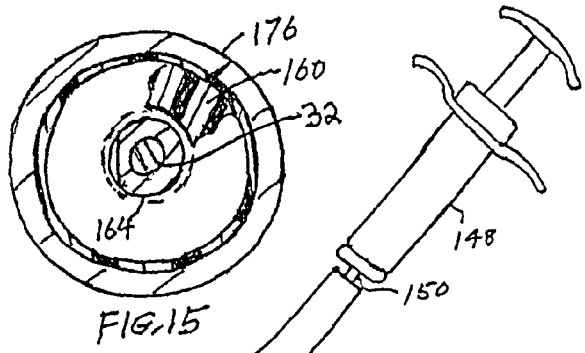
FIG. 15 is a cross-sectional view taken along line 15-15 of FIG. 13 in the direction of the arrows.
Figure 27:
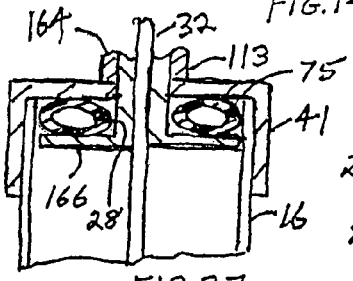
FIG. 27 is a partial view of the head means of FIG. 20 and showing a variation in the structure of seal body 56.
Figure 13:
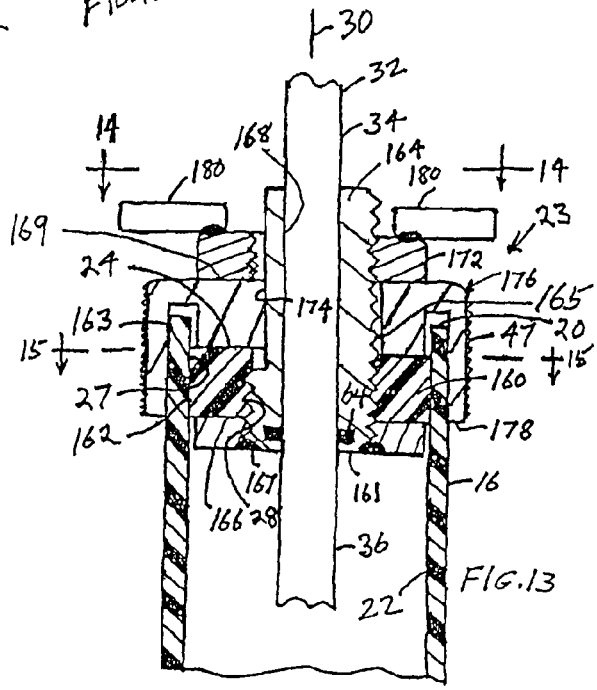
FIG. 13 is a view as in FIG. 12 showing a more preferred type of mixer head means.

Referring to FIGS. 13, 14 and 15 wherein structure substantially equivalent to that of FIG. 12 are numbered the same, bushing 164 is provided with a flat 174 over which a pressure cap 176 of special configuration is mounted. This cap is dimensioned and shaped to slide down over bushing 164 and the open neck 163 of a tube and be held by hand from rotating while nut 172 is tightened against the upper surface 169 of the cap to bulge seal body 160 as at 59. The outer cylindrical wall 178 of the cap prevents excessive outward bulging of the tube neck wherein such bulging might be a problem for some tubes having thin or weak walls. Torque arms 180 on nut 172 allow hand tightening thereof.

Referring to FIGS. 16-31, the best modes presently known for practicing the present invention are shown therein and wherein certain structures are numbered as in FIGS. 1-15.

In the embodiments of FIGS. 16 thru 31, the tube 16 is locked to head means 23 in a manner similar to FIGS. 12 and 13. Referring to FIG. 20, head 23 comprises pressure cap means 41 formed to provide a wall 57 dimensioned to provide a tube receiving cavity or pocket 177 for snugly, slidably receiving the filler end 20 of tube 16. The elastomeric body 56 of seal means 24 is substantially cylindrical in shape having a substantially uniform diameter periphery 186 in its uncompressed condition but is bulged laterally as shown at 59 in its compressed sealing condition wherein the upper portion 27 of the tube 16 is pressured against the bulge 59 to lock the tube to the head means 23.

Head means 23 further comprises a bushing such as 164 but having a substantially oblong bushing bore or cross-section stem 73 threaded as at 165 and having flats 61 for preventing rotation of the bushing in the mating and substantially oblong bushing bore or aperture 65 provided thru the top 67 of cap means 41 and thru which the bushing can longitudinally slide. A circular tightening knob 69 having internal threads 71 is adapted to be threaded onto bushing 164 and tightened against cap top 67 such that the pressure plate portion or second shoulder means 166 of the bushing and top 67 will compress body 56 between its top 182 and bottom 184 surfaces and bulge it radially to frictionally lock adjacent the inner wall surface 188 of the tube and seal the tube between body 56 and recess wall 57. It is noted that body 56 may have various cross-sectional configurations and constructions such as the elastomeric, resilient air filled doughnut 75 shown in a compressed operational condition in FIG. 27.

Figures 16, 17, 18, 19, 20A, 25, 28, 30:
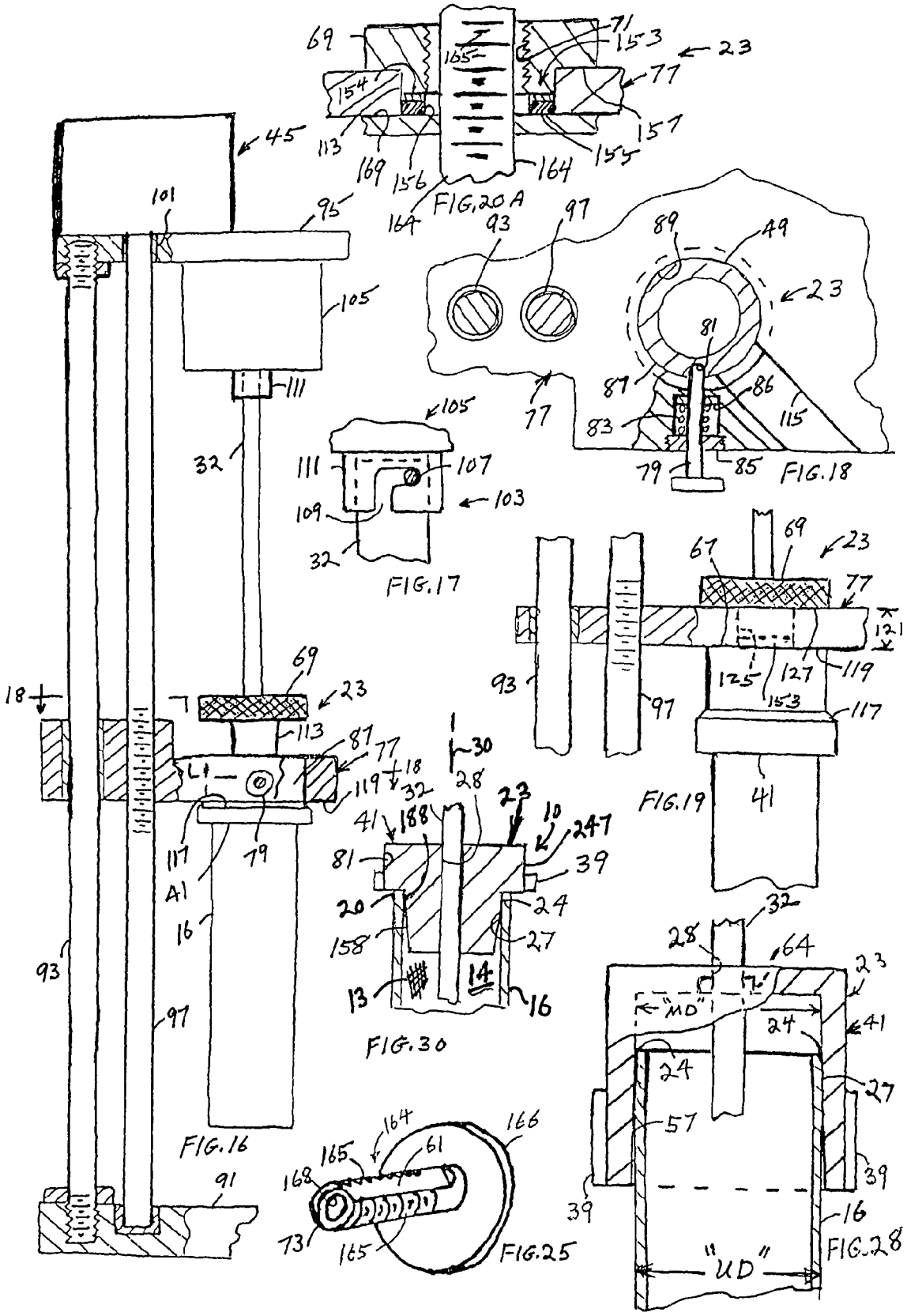
FIG. 16 is a partially sectioned side elevation view of an electrical motor powered reciprocation apparatus with the present preferred mixing head structure mounted on a carriage means.
FIG. 17 is an elevation view of a useful means for quickly connecting the mixer shaft to a rotative power source.
FIG. 18 is a view taken generally along line 18-18 of FIG. 16 in the direction of the arrows.
FIG. 19 is a view as in FIG. 16 of a variation in the connection of the carriage means to the mixer head means.
FIG. 20A is an enlarged cross sectional view of the portion of head 23 which clamps onto carriage 77.
FIG. 25 is a perspective view of the bushing of FIG. 20.
FIG. 28 shows a variation in mixing head structure.
FIG. 30 is a cross-sectional view of a variation of the tapered seal construction of FIG. 28 wherein inner portions of the tube filler end wall provide a component of the seal.
Figure 20:
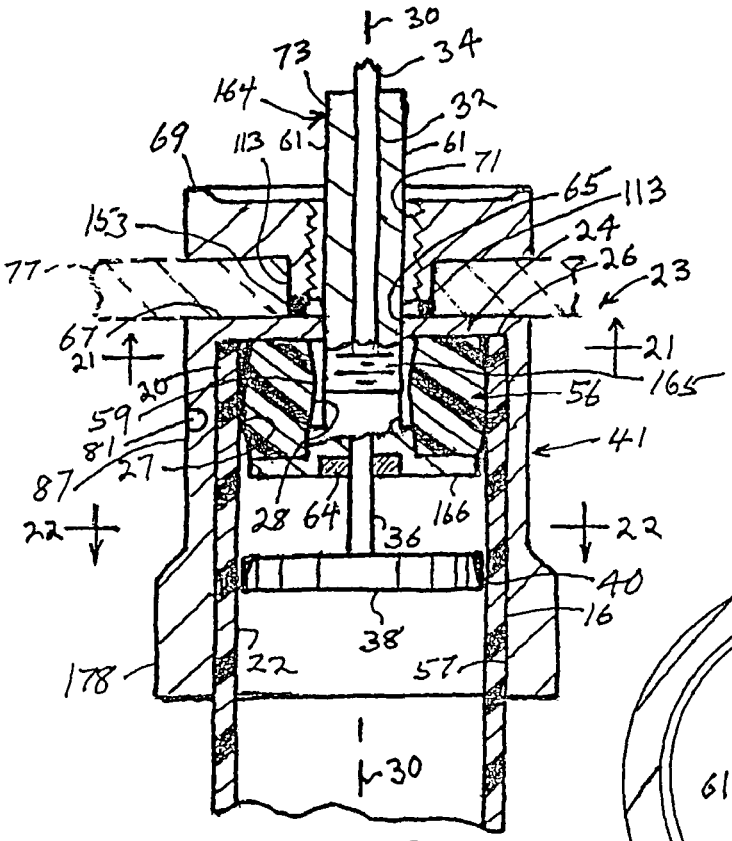
FIG. 20 is a longitudinal cross-section of a preferred head means.

As shown in FIG. 16 head means 23 with the tube 16 locked thereto is removably affixed to a carriage means 77 of any desired configuration and preferably provided with a retractable positioning pin 79 or equivalent which is adapted to fit within a recess 81 in the wall portion 87 of cap 41 (see FIG. 20) to removably lock head 23 and tube 16 to the carriage 77 in a desired position. Compression spring 83 is compressed between a plug 85 threaded into 77 and a shoulder 86 affixed to pin 79 to continually urge the pin toward an aperture 89 in the carriage, in which aperture the cap 41 is to be locked as hereinafter described.

In FIG. 16 an apparatus is shown for reciprocating the carriage 77 and tube and comprises a base 91 to which is affixed a stanchion 93 which is slidably mounted thru the carriage and supports at its upper end a header means 95. A threaded spindle 97 is rotatably mounted on base 91 and is threaded thru the carriage and rotatably passes thru a bearing 101 in 95. An electric motor 45 or equivalent is mounted on 95 and its output shaft is connected to spindle 97. This motor is preferably adapted to rotate the spindle at any desired speed and to reverse its rotational direction in order to cycle the carriage and tube up and down at a rate to achieve good mixing. Another electric motor 105 or equivalent is mounted on 95 and is adapted for connection to shaft 32 by a bayonet type connector 103 or equivalent as shown in FIG. 17 wherein pin 107 is on shaft 32 and slot 109 is on the output shaft 111 of the motor.

The assembly of the head 23 on the carriage 77 with tube attached in operating condition with shaft 32 extending outwardly a desired extent is carried out by positioning the neck portion 113 of the head into channel 115 in the carriage, pulling pin 79 outwardly from aperture 89, moving 113 inwardly until wall portion 87 is laterally within the perimeter of aperture 89, thrusting the head upwardly until shoulder 117 thereon abuts the underside 119 of the carriage, releasing pin 79 to allow it to engage against wall portions 87, and rotating the head until the pin automatically inserts into recess 81 by way of spring 83. At this point the shaft 32 can be extended upwardly by the operators hand force to make the connection shown in FIG. 17. It is noted that where reverse rotation of shaft 32 is desired, a type of connector other than 103 should be used such as, e.g., a setscrew. The length of stroke of the carriage is preferably regulated by limit switches or the equivalent in the manner shown in FIGS. 1 and 2. Other types of regulatory means such as light or other radiation sensing devices may, or course, be employed.

It is noted that for any of the embodiments shown herein the head 23, carriage 77 and tube 16 may be held stationary while the shaft 32 and motor 105 are reciprocated. Such a variation is readily made, for example, by attaching the carriage 77 in fixed position on a lower portion of stanchion 93 and disconnecting it from spindle 97, and removing motor 105 from header 95 and affixing it to a carriage such as 77 as the carriage and its mounting are shown in FIG. 16.

Referring to FIG. 19, the phantom lines of 77 in FIG. 20, and to FIG. 20A the assembly of head 23 with carriage 77 can be done by way of (1) making the aperture 89 of a diameter approximately the same as the width of channel 115 which preferably is only slightly wider than the diameter of neck 113 of the tightening knob 69, (2) dimensioning the head components and the thickness 121 of the carriage such that with the tube 16 clamped by an initial force to the head, the neck 113 can be slid thru channel 115 to aperture 89 and the knob 69 then further tightened a small but sufficient degree to clamp the carriage between the underside 127 of the knob and the top 67 of the pressure cap 41, and (3) employing a compressible pressure element such as 153 comprised of an annular metal washer component 154 and an annular elastomeric buffer component 155 wherein bushing 164 is slidable thru the center opening 156 of said element and wherein said buffer component is less compressible than body 56 such that seal body 56 will bulge tightly at 59 against the tube wall before said buffer component compresses to the point where the underside 157 of knob 69 tightly engages carriage 77. It is preferred that 154 and 155 be adhesively affixed to each other and that 156 be adhesively affixed to the top 67 of pressure cap means 41.

Figure 24:
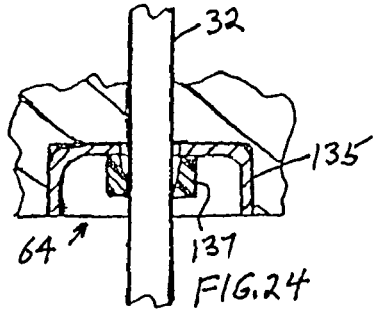
FIG. 24 is a cross-sectional view of a preferred shaft seal mounted in the bushing wherein the diameter of the cylindrical wall is enlarged for clarity.
Figure 21:
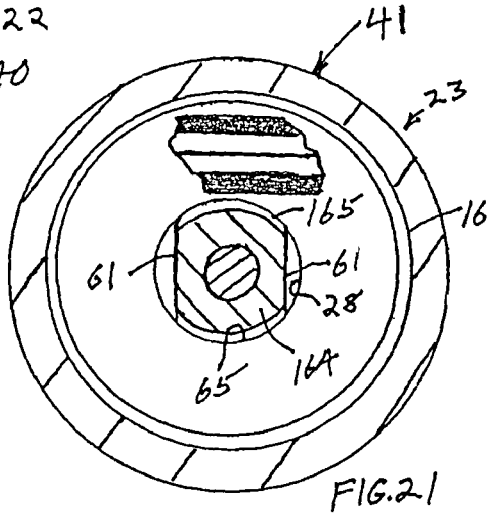
FIG. 21 is a cross-sectional view taken along line 21-21 of FIG. 20 in the direction of the arrows and showing only a portion of body 56 in elastomeric cross-section.

The most preferred shaft seal 64 is shown in FIG. 24 wherein an annular metal housing 135 is adhesively affixed to an annular or ring seal 137 of elastomeric material. For this seal said housing is generally cup shaped and inverted in a distal direction and has a floor section 271 provided with an axially positioned aperture 273 and further having a cylindrical wall 275 contiguously surrounding the periphery 277 of said floor. The wall is press fitted into an enlarged portion 279 of bore 168. The ring seal has a central shaft aperture 281 for receiving in a sealing sliding manner shaft 32 and which opens into a proximally opening generally conical cavity 283, and wherein a proximal opening 285 of said cavity is defined by a generally lateral rim means 287 which is adhesively affixed to a distal portion 289 of said floor section.

Figure 22:
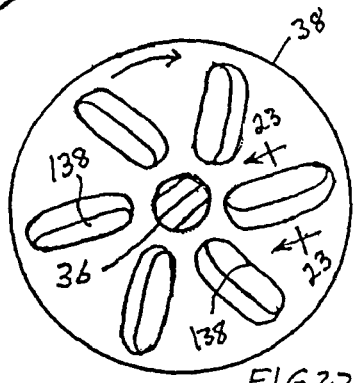
FIG. 22 is a view of a highly preferred impeller taken along line 22-22 in FIG. 20 in the direction of the arrows.
Figure 23:
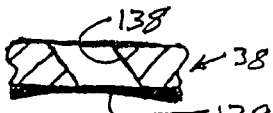
FIG. 23 is a cross-sectional view of the impeller taken along line 23-23 in FIG. 22 in the direction of the arrows.

The most preferred impeller 38 is disc shaped as shown in FIGS. 22 and 23 wherein the mixing blades are in the form of slots 138 tapered from about 30 to about 50 degrees, and wherein the direction of rotation of shaft 32 is clockwise. The construction greatly reduces the whipping of air into the caulk mass during mixing. The bottom 139 of the impeller disc is slightly concaved such that the tube seal 141 will not be damaged if the impeller comes into contact with the tube bottom.

Figure 29:
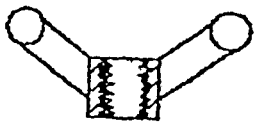
FIG. 29 shows in an alternative tightening means structure for knob means 69 in FIG. 20.
Figure 26:
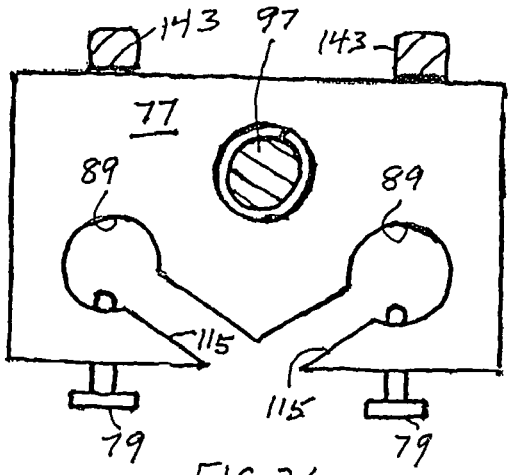
FIG. 26 is a top view of a multiple head carrying carriage.

As shown in FIG. 26 multiple channels 115 and apertures 89 may be provided in the carriage 77 for simultaneous multiple mixings. Stanchion slide guides such as 143 against which the carriage is vertically slidable may be provided to prevent rotation of the carriage during mixing. In FIG. 29 an alternative to knob 69 is shown as a pair of opposed arms having smooth hemispherical ends 145 for easy gripping and rotation.

Referring to FIG. 28, the seal means 24 comprises a slightly tapered, e.g., 1-5 degrees cylindrical recess wall or skirt 57 into which the open filler end of tube 16 is pushed. The frictional contact of the tube with wall 57 is sufficient to seal the tube end and stabilize the shaft 32 axis and impeller within the tube such that rotation and reciprocation of the shaft can proceed smoothly without dislocation of the head 23 from the tube. In FIG. 30 the tapered wall 158 provides the seal and frictional lock of the head to the tube.

For these embodiments which afford quick and easy on-the-job mixing, the cap 41 is preferably provided with ridge projections 39 spaced around the cap for gripping such that in addition to pushing or pulling the tube, rotation of the cap on the tube can be facilitated to ensure proper sealing and to assist in removal of the tube from the head. Also for this embodiment the rotative power means preferably comprises hand rotation or a hand or palm held and small size battery operated electrical motor with its output shaft integral with shaft 32 such that all of the structures of head means 23 desired for convenient and expeditious mixing are integrated into a single hand held unit falling within the ambit of "combination" as used herein.

Figure 31:
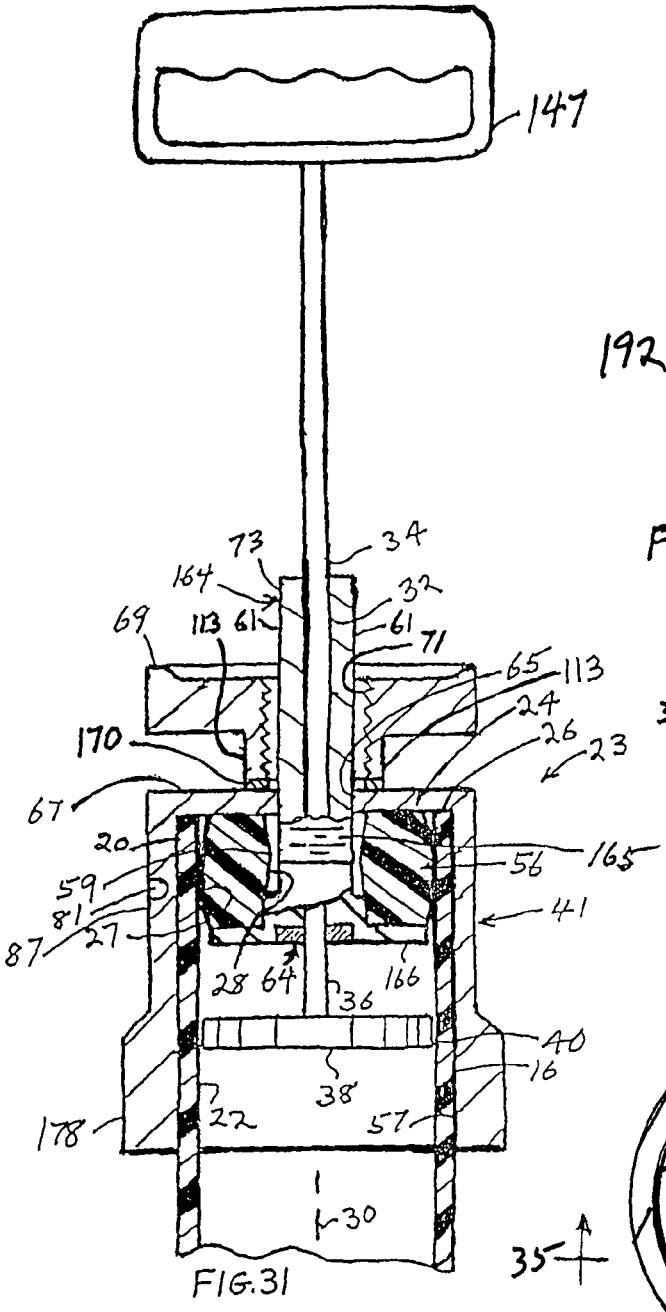
FIG. 31 is essentially the same as FIG. 20 but wherein the shaft is provided with a handle for non-rotative mixing.

In another and highly preferred embodiment of the present invention, particularly the fully hand held and hand operated version as shown in FIG. 31, shaft 32 is provided with a handle 147 by which the operator can reciprocate shaft 32 and impeller 38 without having to rotate the shaft and impeller to intimately mix the components, e.g., caulk and colorant. It is preferred that for this operation, after the colorant is added thru the open top (filler end) of tube 16, the following procedure is followed:

1. Insert shaft 32 and impeller 38 all the way down into the tube thru the caulk wherein 38 is proximate dispensing end 18 of the tube;
2. Position and tighten head means 23 in the tube fill end to seal the tube whereby the pressure within the tube is ambient;
3. Withdraw the shaft and impeller to proximate the tube fill end whereby the pressure within the tube becomes less than ambient, e.g., 7-10 psi., and whereby air which was originally entrained within the caulk now tends to escape therefrom; and
4. Reciprocating, e.g., 10-50 times, the shaft and impeller within the tube between said fill end and said dispensing end whereby the pressure within said tube cycles between ambient, e.g., 14.7 psi., and less than ambient, e.g., 7-10 psi and whereby said colorant is intimately mixed into the caulk and the mix becomes substantially de-aerated.

It is noted that this de-aeration greatly reduces or eliminates "popping" (splattering) of the caulk as it is being pressure forced out thru the dispensing end of the tube. It is apparent, of course, that the above procedure can be carried out by the use of automatic or semi-automatic type reciprocating equipment such as that shown in FIG. 16 but without the need for a motor 104, wherein the outer end of shaft 32 simply could be clamped in a non-rotative position on stanchion 93 during the mixing operation.

It is noted that the head variations of FIGS. 28, 30 and 31 may be provided with means for mounting them on carriage 77 such as recess 81 formed in the sides thereof for receiving a pin such as 79.

In a more instructional rather than basic sense, the mixing method steps which might be preferred from a field use, practical standpoint and using hand power, are as follows:

1. Choose desired base of caulk which may be custom compounded for a particular coloring, texturing, etc. job;
2. Squeeze tube in center to force back plug out or use a pull ring (back) plug or plug extraction tool, with or without vacuum breaking pin or toothpick;
3. If using a 10 oz. tube of caulk, remove one teaspoon of caulk, but note that in some caulk and sealant off-the-shelf tubes, the back plug is quite far down into the filler end, e.g., an inch or more, and thus when the plug is removed the level of material in the tube allows 10 cc or so of additive such as paint to be added into the tube without removal of any material form the tube and without the batch interfering with clamping of the mixing apparatus to the filler end nor with its subsequent operation;
4. Add 2 teaspoons (approximately 10 cc) of paint (latex or oil) into tube of caulk. Do not over fill or leakage will occur;
5. Wipe excess caulk and paint from inside the tube approximately one inch down into the tube;
6. Slide mixer head onto filler end (back) of tube;
7. Push mixer shaft to bottom of tube (before tightening on mixer head) to assure vacuum mixing and prevent leakage;
8. Tighten locking nut to secure mixer to tube;
9. Push and pull handle for 1 min. (approx. 40 cycles);
10. To remove, pull handle out, tap opposite end of tube to repack caulk;
11. Loosen lock nut and remove mixer;
12. Replace back plug, placing toothpick or pin along outside of sealing wall of back plug to release pressure;
13. Push in back plug until it touches caulk;

14. Remove toothpick or pin and wipe excess caulking from tube;

15. Use tube of caulking in regular manner;

16. Clean mixer immediately after each use with soap and water if using latex caulk. (clean with acetone if using silicone caulk). Oil mixer shaft seal lightly with silicone lubricant.

In order for the preferred and best mode embodiments of the present invention to work properly and to produce the most convenient and expeditious mixing results, the pressure cap means 41 must be so constructed that it does not interfere with or impede the operators hand gripping of the tube 16 as the operator is assembling or disassembling the head 23 and tube and, if desired, as the operator is holding the tube during the mixing operation. To this end and with the cap affixed to the tube, the downwardly depending wall 178 or other portions of the pressure cap should allow at least about a hands width of at least about four inches of the tube dispensing end 18 to protrude beyond wall 178. Therefore, it is preferred that a total length of the cylindrical recess wall 57 of pressure cap means 41 does not exceed three inches even where a reciprocating apparatus as shown in FIG. 16 is employed since proper placement of the head and tube in the carriage means 77 is greatly facilitated where the operator can hand grip the tube. It is noted that an experienced operator by hand gripping a tube 16 can remove thrust cap seal 17, feed additive thru the tube filler end 20, assemble the head 23 onto the filler end 20, reciprocate the shaft 32 and impeller 38 to mix the components, remove the head from the tube, and replace seal 17 in the tube in a very short time, e.g., less than a minute or two, particularly when the combination is only hand supported during the mixing operation.

Figure 32:
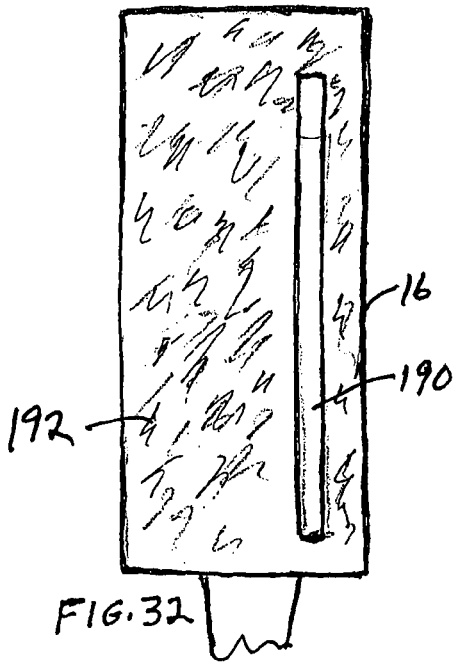
FIG. 32 is a side view of a typical caulk tube wherein the tube is provided with a clear, longitudinal window for viewing the caulk-colorant mix.

In FIG. 32 caulk tube 16 which can be of any material such as laminated paperboard, cardboard, metal, plastic or the like is provided with at least one clear walled portion such as the clear window strip or other window configuration 190 which allows a view of the progress of the mixing operation of whatever ingredients are being mixed. Where the tube wall is formed of clear plastic, any amount of labeling 192 or the like can cover the tube as long as a window such as 190 is provided.

The following recitation of an embodiment of the present method with identifying numerals is given to clarify an exemplary preferred structure for carrying out the present method.

A method for mixing together two or more components such as caulk and additive, resin and curing agent, or the like in a cylindrical tube 16 wherein the tube has a longitudinal axis 30, a sealed dispenser end section 18, and a filler end section 20 having inner surface portions 22 defining a cylindrical fill opening into said tube, said method comprising the steps of (a) adding said components into said tube thru said filler end section 20, (b) positioning on said filler end section a mixing apparatus comprising mixer head means 23 having a cap member 41 with a top portion 67 having an outer proximal surface 159 and an inner distal surface 175 wherein a bushing bore 65 is formed axially through said top portion, a cap wall portion or skirt 178 depending distally and axially from said top portion and providing a cylindrical tube receiving cavity 177 formed by said wall portion 178, said cavity having a diameter substantially the same as the outside diameter of said tube and adapted to slidingly receive said filler end thereof, elongated bushing means 164 mounted thru said bushing bore with a proximal end 179 thereof extending above said top portion and provided with laterally extending first shoulder means 165, a distal end 161 of said bushing means extending into said cavity and provided with laterally extending second shoulder means 166, tube seal means 24 having a generally cylindrical configuration with a thick, deformable, elastomeric body 58 having top 182 and bottom 184 surfaces and being axially mounted on said bushing means between said inner distal surface and said second shoulder means, the outer periphery 186 of said body in its relaxed condition having a diameter substantially the same as the inside diameter of said tube, compression means 69 being engageable with said first shoulder means and said outer proximal surface of said top portion for pulling said second shoulder means against said bottom surface of said body while forcing said top surface of said body against said inner distal surface of said top portion whereby said body will be axially compressed and radially expanded and said outer periphery 186 of said body will be forced radially against an inner wall surface 188 of said tube to radially expand tube wall portions tightly against said cap wall portion to frictionally lock said apparatus to said tube preparatory for the mixing operation, a shaft bore 168 is formed thru said bushing means substantially on said longitudinal axis, elongated mixer shaft means 32 is mounted thru said shaft bore for reciprocating axial motion relative to said tube, said shaft means having a proximal end 24 lying axially proximally of said top portion and having a distal end 36 adapted to lie within said tube, mixer impeller means 38 is mounted on said distal end 36 and has peripheral portions 40 adapted to lie closely adjacent to said inner surface of said tube to substantially wipe said components therefrom by way of axial reciprocation of said shaft means, said proximal end being adapted for engagement with a power source for axially moving said shaft means and impeller means substantially completely thru material contained in said tube in a reciprocating manner, (c) actuating said compression means 69 to frictionally lock said mixing apparatus to said tube, (d) starting relative reciprocation of said mixer shaft means within said tube, (e) continuing the reciprocation for a desired mixing period, and (f) deactuating said compression means and removing said mixing apparatus from said tube.

An exemplary set of structural approximate dimensions and operating parameters for carrying out the present invention in the best mode known by Applicant for coloring an off-the-shelf tube of clear elastomeric latex sealant, DAP®, DYNAFLEX 230®, wherein ΔD is the increase (inches) in diameter of periphery 162 of seal or gripping body 56 or 160 by way of the longitudinal compression thereof between second shoulder means 166 and tightening means, e.g., 164, 170, 172, and wherein LC is the length (inches) of the longitudinal compression, is as follows:

| | |
|---|---|
| 1. Off-the-shelf sealant tube total length (without dispenser nozzle) | 8.5 in. |
| 2. Tube diameter (O.D.) | 1.93 in. |
| 3. Tube diameter (I.D.) | 1.85 in. |
| 4. Tube wall thickness | 0.04 in. |
| 5. Sealant volume in tube (per manufacturer) | 300.00 ml |
| 6. Back-plug clearance from distal end of tube | 1.0 in |
| 7. Longitudinal thickness of rectangular cross-section of seal body (56) | 0.75 in. |
| 8. O.D. of seal body (56) | 1.73 in. |
| 9. Bushing bore (28) diameter thru seal body (56) | 0.66 in. |
| 10. Thickness of second shoulder means (166) | 0.15 in. |
| 11. ΔD/LC ratio | 1.19 |
| 12. Shaft mixing end portion length | 7.6 in. |
| 13. Shaft mixing end portion diameter | 0.31 in. |
| 14. Volume of shaft mixing end portion | 0.58 $in^3$. |
| 15. Volume of mixing cavity of tube (321 cc) | 19.62 $in^3$ |
| 16. Ratio of item 15 (19.62 $in^3$) to item 14 (0.58 $in^3$) | 33.82 |
| 17. Inside diameter of skirt 178 | 1.94 in. |
| 18. Length of skirt 178 | 1.63 in. |
| 19. Longitudinal thickness of impeller | 0.25 in. |

-continued

| | |
|---|---|
| 20. Total area of apertures thru impeller as % of impeller top surface | 57.0% |
| 21. O.D. of impeller | 1.79 in. |
| 22. O.D. of second shoulder means | 1.83 in. |
| 23. Threads/in. on bushing (164) | 7.0 |
| 24. Revolutions of knob (69), after initial contact of seal body with compression means, used to sealingly affix head means (23) to tube, with over 40 lbs of axial pull force required to extract fill end of tube from the head means (23) | ¾–1 rev. |
| 25. Depth into tube of bottom of second shoulder means (166) during mixing | 0.92 in. |
| 26. Composition of pressure cap member (41), bushing (164), second shoulder means (166), and tightening knob (60) (no washer 170 needed) | molded structural plastic |
| 27. Composition of shaft seal (64) | Neoprene |
| 28. Elastomeric composition of seal body (56) any of (preferred), Natural Rubber, Butyl Rubbers, Halogenated Butyl Rubbers, Chlorosulfonated Polyethylene, Polybutadiene, Nitrile Rubber, Chloroprene Rubber, Ethylene-Propylene Terpolymers. | Neoprene |
| 29. Mixer shaft (32) | Polished Stainless Steel |

Figure 33:
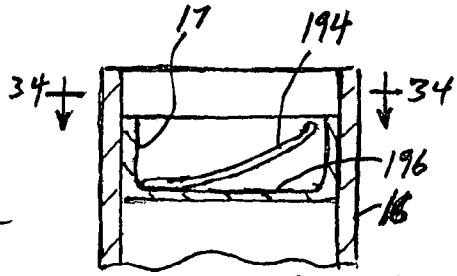
FIG. 33 is a cross-sectional view of a filler end of a caulk tube showing the back plug provided with a pull-out tab or ring.
Figure 34:
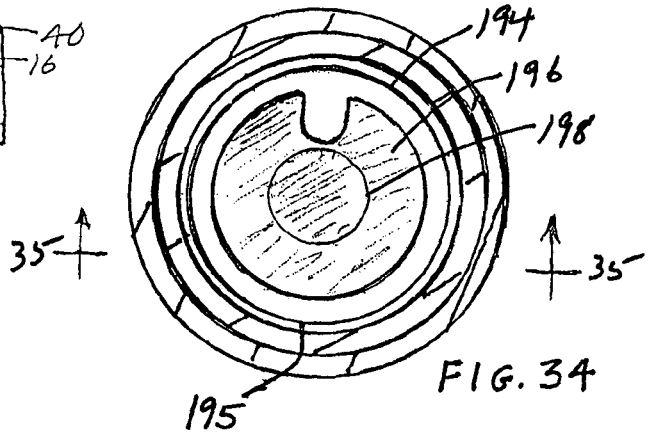
FIG. 34 is a cross-sectional view taken along line 34-34 in FIG. 33.
Figure 35:
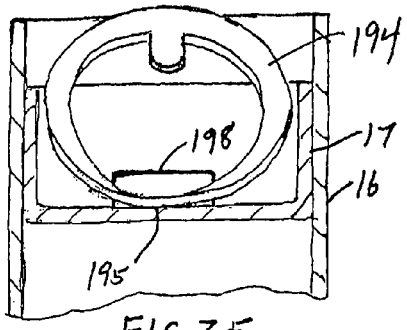
FIG. 35 is a cross-sectional view taken along line 35-35 in FIG. 34.

Referring to FIGS. 33, 34 and 35, the back plug or thrust cap seal 17 is provided with a pull ring or tab 194 affixed to or molded onto the back plug floor 196 at one edge thereof, and which ring or tab preferably lies flat on the back plug floor when not in use. When in use, the ring or tab is pulled upwardly from one edge 195 as shown in FIGS. 33 and 35. Pliers may be used to assist in pulling the ring or tab. It is noted that the configuration of floor 196 may vary between manufacturers, for example, some have a central raised portion 198, and the pull ring structure and other back plug extraction tools hereinafter described can be tailor fitted to function for extracting any conventionally shaped back plug.

The back plug gripper or extraction tool embodiment of FIGS. 36, 37, 38 and 39, and generally designated 203 is adapted for extracting a back plug from a caulk tube having a longitudinal axis wherein the plug is of thin flexible material and is generally cup shaped to have a floor 196 and a cylindrical tube sealing wall 197 surrounding the perimetric edge 199 of the floor. Sealing wall 197 of the plug has an inner cylindrical surface 200 defining a well 202. The tool comprises body means 204 having a proximal end 206 and a distal end 208, the distal end being adapted to fit down into the well. Radially expandable gripping structure 210 is mounted on the distal end of the body means and has gripping portions or points 212 adapted to frictionally engage and indent into inner surface 200.

Body means 204 has at least one perimeter portion or segment 218 (FIG. 37) adapted for positioning proximate inner surface 200 and any practical number, e.g., 2, 3 or 4 of said tine means 210 are slidably mounted in bearing means 219 formed generally laterally in the body means and extending thru said perimeter segments whereby the tine means can slide in the bearing means into and out of gripping contact with inner surface 200. Bore means 220 is formed in the body means and houses an inner end 222 of the tine means.

Actuator means 214 is provided on the tool for imparting radial expansion force to the gripping structure for forcing the points 212 into engagement with the inner surface 200 whereby the tool with the plug attached thereto can be pulled outwardly axially of the tube. Actuator means 214 comprises a shaft means 224 having cam means 226 engageable with the inner end of the tine means, and handle means 228 is affixed to the shaft means for controlling contact of the cam means with said inner end.

A pair of finger grips 225 are preferably provided on body 204 whereby handle 228 and said grips can be squeezed together vertically to impart as much caming force on tine ends 222 as is needed for the points 212 to strongly grip inner surface 200 for extracting the plug.

Affixed to body means 204 are one or more vacuum breaking pin means 230 mounted above the distal end 208 and extending radially outwardly of said distal end and downwardly beyond said distal end. This pin means is preferably of strong, needle quality steel and is flexible such that an operator can flex the pin means radially inwardly as shown by dotted arrow 232 in FIG. 39 to slide downwardly between the inner wall surface 22 of the tube and sealing wall 197 of the plug as said distal end 208 is being inserted into the well, whereby one or more vacuum breaks 234 (FIG. 38) in the tube occurs and facilitates extraction of the plug therefrom. A spring means or release structure 216 such as a flat strip spring steel member is connected between the body means and tine means for urging the tine means out of contact with inner surface 200 when it is desired to remove the tool from the plug. As an assist to this release spring, a compression spring 217 may be provided to retract actuator means 214 when thumb pressure is removed from 228.

Figure 41:
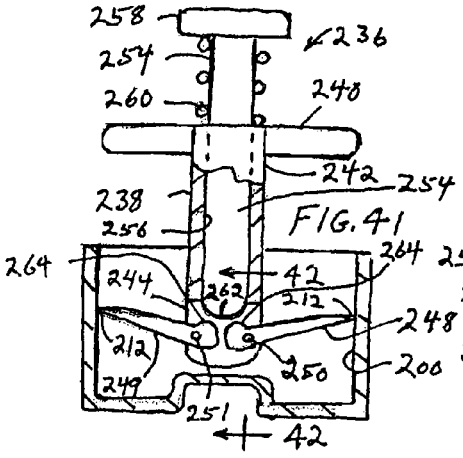
FIG. 41 is a partial cross-sectional view of a variation of the extraction tool of FIG. 36 in place in a back plug.
Figure 42:
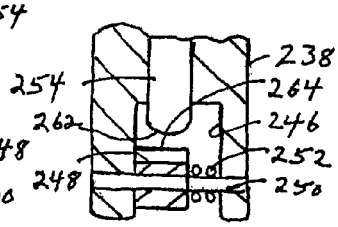
FIG. 42 is a cross-sectional view taken along line 42-42 in FIG. 41.

Referring to FIGS. 41 and 42, a variation of the extractor tool is generally designated 236 and comprises body means 238 having handle means 240 on its outer end 242 and having its inner end 244 slotted at 246. A pair of radially opposed gripping arms 248 and 249 are pivotally mounted in slot 246 by pins 250 and 251 around which are mounted torsion springs such as 252 having its end portions abutting the arms and the body means to provide a constant rotative force to the arms urging them downwardly to engage their gripping portions or points 212 with surface 200 of the plug as shown in FIG. 41.

A release structure for allowing removal of the tool is provided comprising plunger 254 which is slidably mounted in bore 256 in body 238 and can be depressed by thumb pressure on button 258 against the force of spring 260 to engage end 262 of the plunger with the inner ends 264 of said arms to rotate portions 212 upwardly and out of contact with surface 200.

Figure 36:
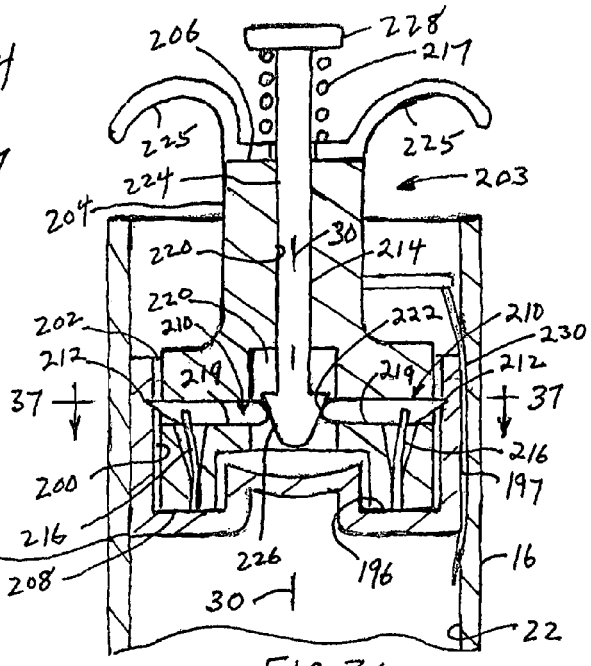
FIG. 36 is a cross-sectional view of a filler end of a caulk tube showing a plug gripping structure or extraction tool in to pull the plug from the tool.
Figure 37:
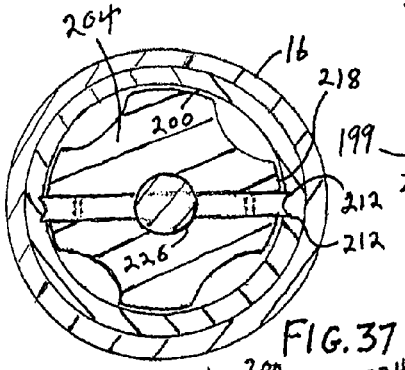
FIG. 37 is a cross-sectional view taken along line 37-37 in FIG. 36.
Figure 38:
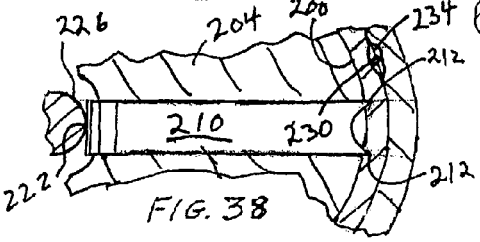
FIG. 38 is an enlarged portion generally bracket dotted in FIG. 37.
Figure 39:
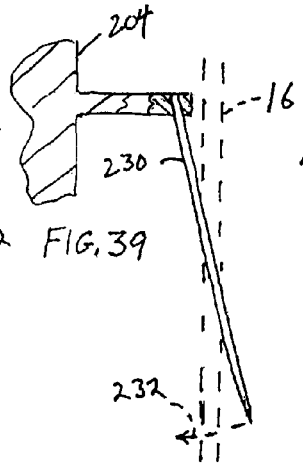
FIG. 39 is a view of the vacuum break pin of FIG. 36 showing its initial posture relative to the tube wall prior to its being flexed radially inwardly to allow insertion of the extraction tool.
Figure 43:
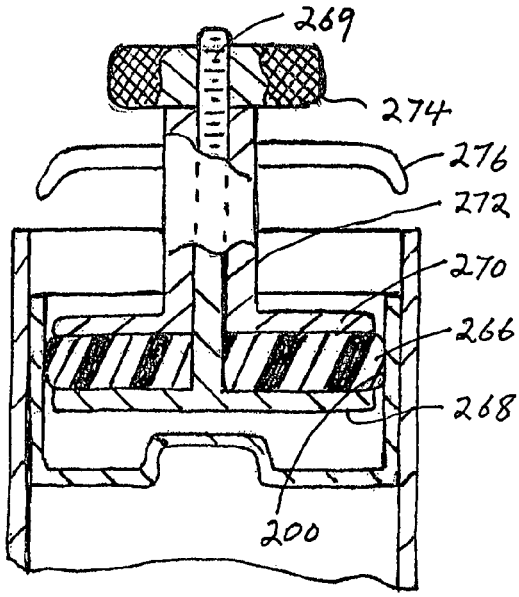
FIG. 43 is a partial cross-sectional view showing a further variation of a plug extraction tool in place in a back plug.

Referring to FIG. 43, a further embodiment of the extractor tool is shown wherein the radially expandable gripping structures of FIGS. 36 and 41 are modified to comprise a compressible elastomeric body 266 such as seal body 56 which is clamped between a circular bottom plate 268 affixed to a threaded shaft 269, and a circular top plate 270 affixed to body member 272. A hand nut 274 when screwed down on shaft 269 will compress circular body 266 between 268 and 270 and expand (bulge) it radially outwardly to frictionally engage surface 200 with sufficient force to allow the back plug to be pulled from the tube by upward hand pull force on handle 276. Release of the plug occurs by unscrewing nut 274.

Figure 40:
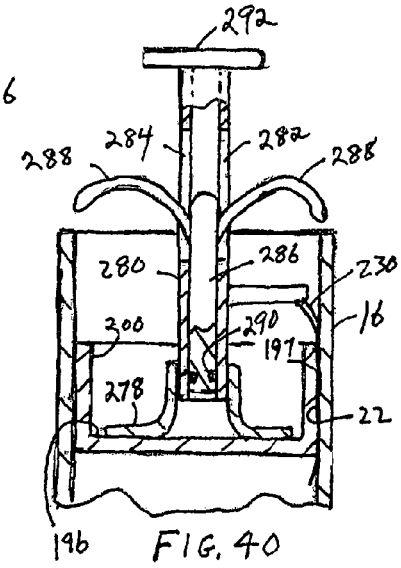
FIG. 40 is a partial cross-sectional view of a tube filler end with a suction operated plug extraction tool in place in the back plug.

In the extractor tool structure of FIG. 40, a circular suction cup 278 is hermetically affixed to the inner end of tubular body 280 which is slotted on opposite sides at 282 and 284. A vacuum generating piston 286 is slidably mounted in body 280 and a pair of handles or finger grips 288 are affixed to the body and extend outwardly thru said slots to allow the piston to slide up and down within body 280. An O-ring seal 290 or equivalent surrounds piston 286 and forms an airtight sliding seal between the piston and body 280. In using this tool, the body 280 with suction cup 278 is pressed downwardly by handle 292 on the body to forcibly engage the suction cup with plug floor 196, and with the hand palm pressing down on button 292, the fingers are pulled (squeezed) upwardly underneath handles 288 to pull the piston up into the body and create a substantial vacuum between the suction cup and plug floor 196. Continued pulling upwardly on 288 will extract the back plug from the tube. Releasing the finger pressure on 288 will release the piston and vacuum and allow removal of the tool from the plug.

Figure 44:
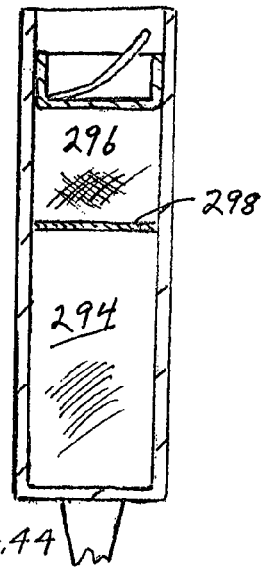
FIG. 44 is a cross-sectional view of a caulk type tube but showing individual ingredients to be mixed by the present mixing device and separated therein by a puncturable partition.

Referring to FIG. 44 a tube such as 16 is shown as containing two ingredients 294 and 296 separated by a non-reactive and non-polluting pressure puncturable membrane or separator 298 such as a wax seal as known to the art. The ingredients can be of any chemical composition including, for example, liquid, paste, powder or granular solids, suspension or the like, including the resin 294 and curing agent 296 of epoxy paints or adhesives or the like. In this regard, the resin 294 can be originally in the tube and the curing agent can be added thereto from a packet such as 302 described below. In this case, the separator is not needed. Any number of such ingredients and separators can be incorporated into the tube for mixing by the present mixing apparatus.

Figure 45:
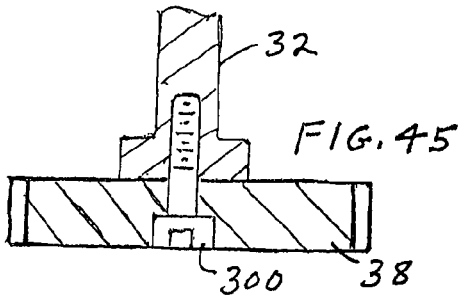
FIG. 45 is a cross-sectional view of an impeller means which is rotatably on the end of the mixer shaft.

In FIG. 45 is shown a variation of the mixing impeller wherein the impeller 38 is rotatably mounted on the mixer shaft 32 by, e.g., Allen screw 300. This structure allows the impeller to rotate within the tube during mixing even though the shaft itself reciprocates but does not significantly rotate.

Figure 46:
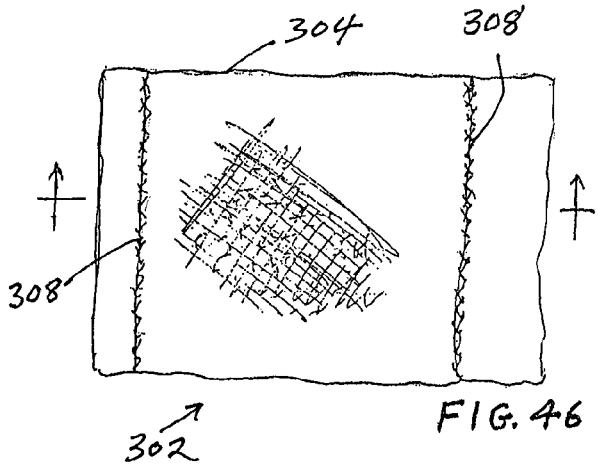
FIG. 46 is a top view of a sealed packet containing colorant.
Figure 47:
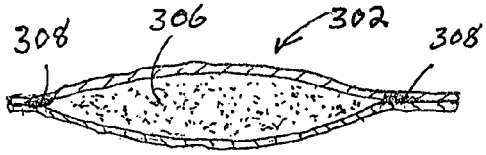
FIG. 47 is a cross-sectional view taken along line 47-47 in FIG. 46.

Referring to FIGS. 46 and 47 a colorant containing, or other ingredient containing packet generally designated 302 is shown in substantially one actual useful size and comprises an individual dispenser container 304 for each measured amount of selected colored paint, equivalent colorant, or ingredient wherein at least portions of the container are comprised of substantially clear plastic material to afford viewing of the colorant or other contents 306. "Equivalent colorant" means an amount of pigment, dye or the like, in liquid, solid (powder, chip, etc.) or suspension form which will color the caulk to the same color as a packet of selected paint. The "selected colored paint" for a large number of packets can be taken of course from any can or cans of a certain base and color whether the cans are all from the same batch or not, since the color from batch to batch or can to can typically does not noticeably vary. It is noted that for a common 10 ounce tube of caulk or grout, about 2-3 teaspoons or approximately about 10 cc of paint will impart the desired color.

The packet plastic material preferably is polyolefin, polyamide, polycarbonate, cellulose ester, or the like in the form of a flexible plastic tube of from about 1-5 mil thickness, generally rectangular in shape and containing from about 5 to about 20 cc of colorant. This tube is hermetically sealed as at 308 at its end portions and is readily openable by knife, scissors or the like for pouring the colorant or other contents into said caulk or ingredient mixing tube.

Any types and configuration of additive container can be of use in carrying out the present invention including—in addition to the above packets plain capped bottles, eye dropper type plastic or glass squeeze bulb bottles, plastic squeeze bottles, capped bottles, tab opening cans such as miniature soda pop cans or the like.

Figure 48:
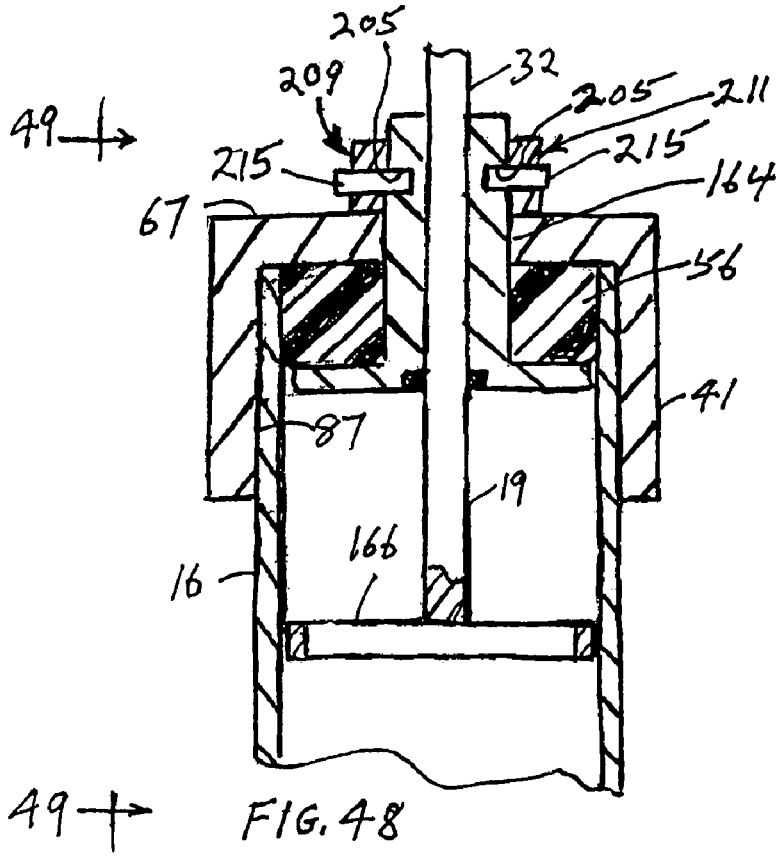
FIG. 48 is a cross-sectional view of a variation of the seal body compression means.
Figure 49:
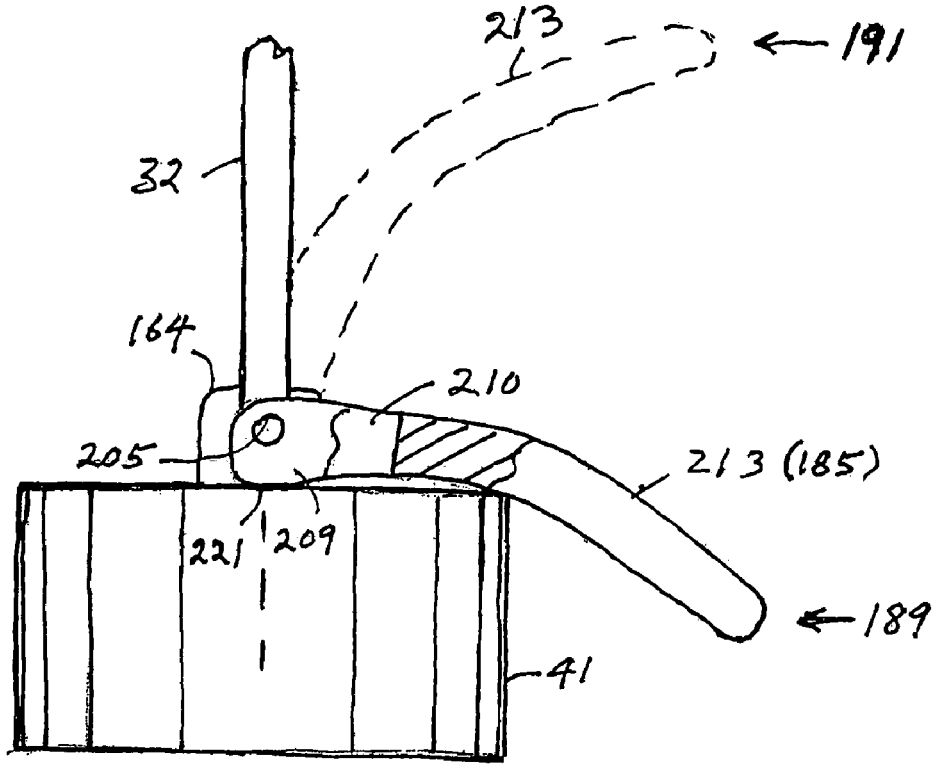
FIG. 49 is a side view taken along line 49-49 in FIG. 48.

Referring to FIGS. 48 and 49, a camming mechanism rather than a nut and threaded bushing type of compression means for bulging seal body 56 is shown. In this variation the first shoulder means comprises the stud receiving bores in opposite side portions of bushing means 164, and the compression means 207 comprises arms 209 and 211 of a camming lever 213. Pins 215 secure the lever pivotally to bushing 164. Lever 213 is shown in solid line in FIG. 49 in its compressing posture wherein the high point 221 of the cam ends of arms 209 and 211 are forcibly in engagement with top surface 67 of the pressure cap 41 such as to compress and radially bulge body 56. The dotted lines represent the release position of lever 213.

Figure 50:
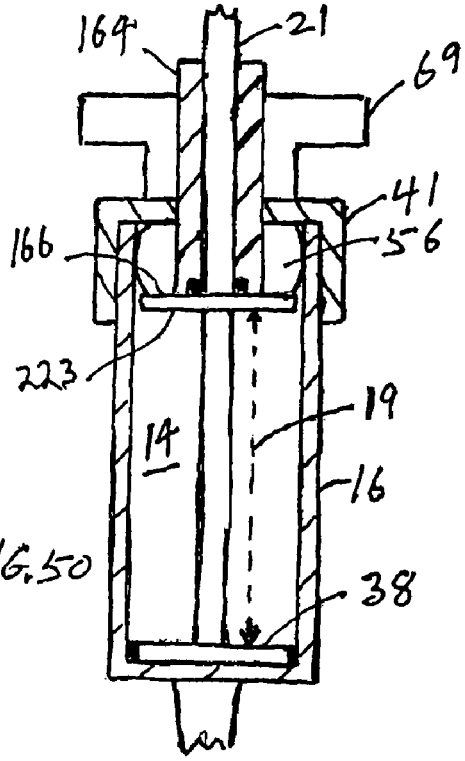
FIG. 50 is a cross-sectional view of the tube and mixing head showing the dimensions of the mixer shaft mixing end portion and operating end portion.
Figure 53:
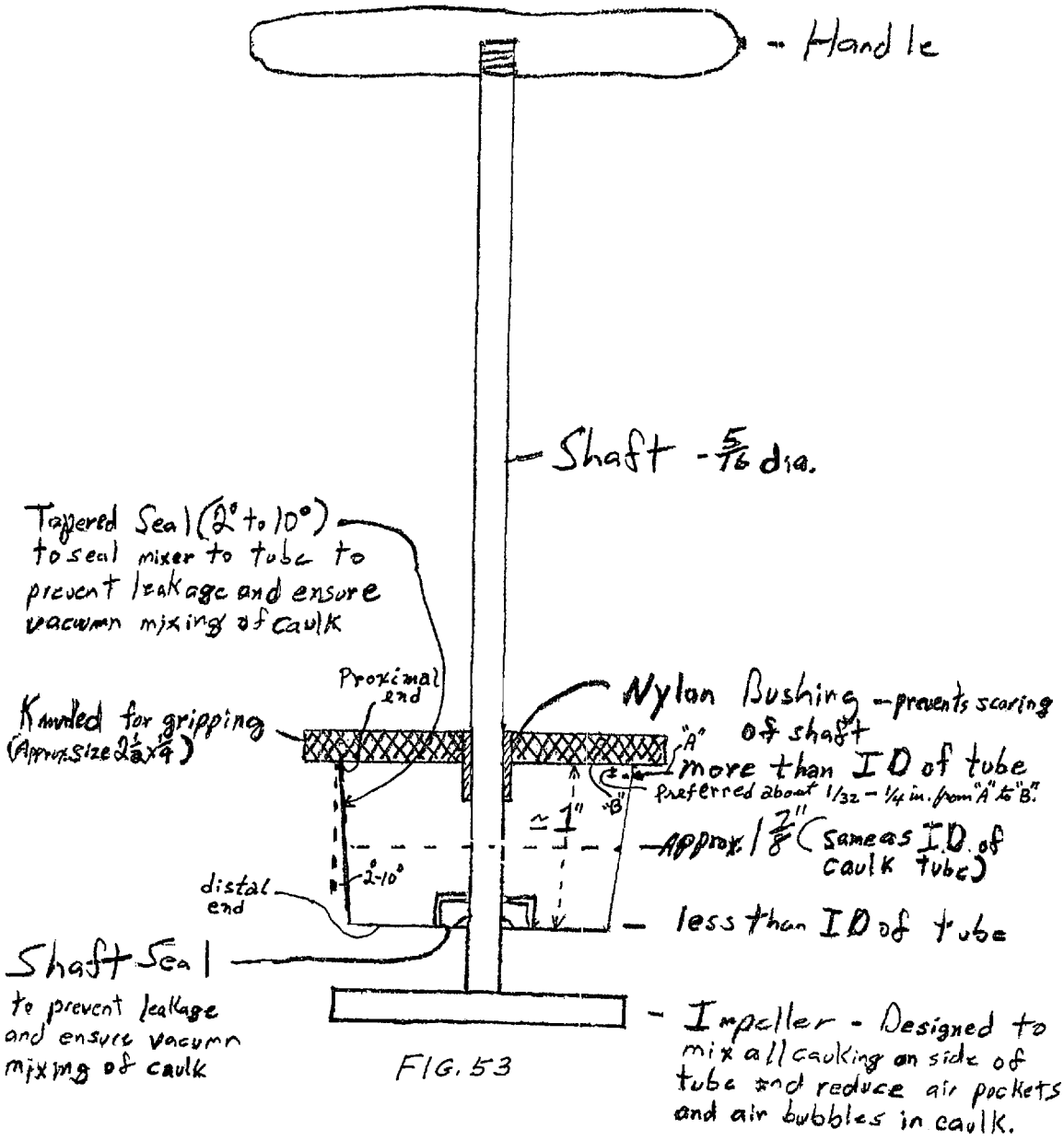
FIG. 53 is a view similar to FIG. 30 and giving further details to the stopper type apparatus embodiment of the present invention.

Referring to FIG. 50, mixing end portion 19 of shaft 32 extends from the bottom surface 223 of the second shoulder means plate 166 to the top surface of the impeller means 38, and the operating end portion 21 of the shaft extends from surface 223 axially outwardly any convenient distance to handle 147 or other power means.

Figure 51:
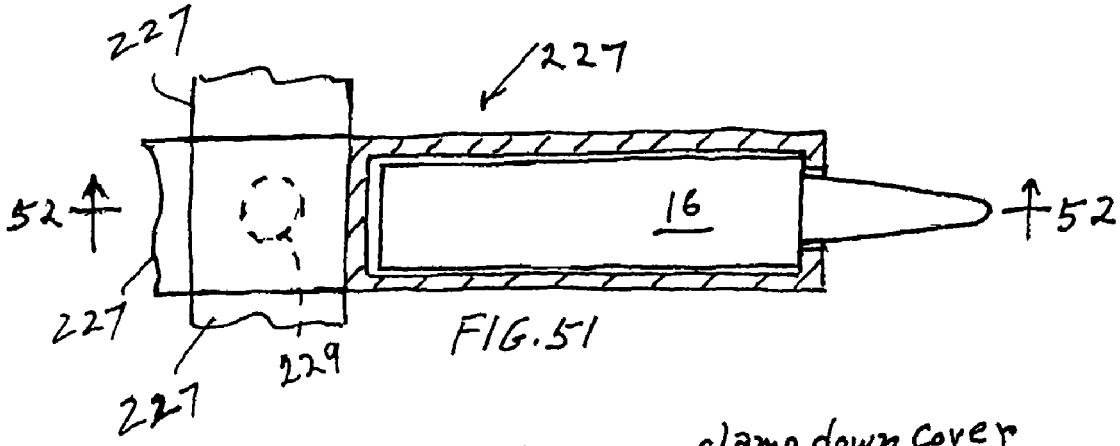
FIG. 51 is a top view of a tube centrifuging apparatus.
Figure 52:
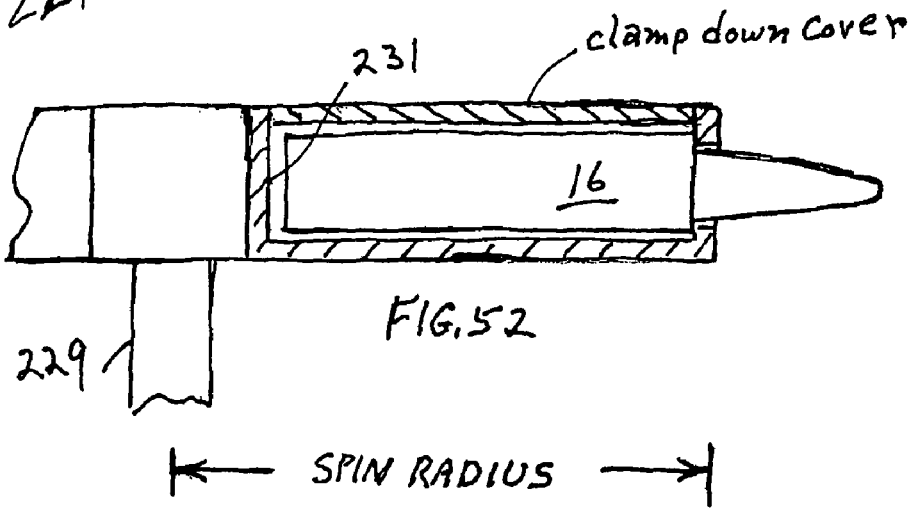
FIG. 52 is a side view taken along line 52-52 in FIG. 51 with portions broken away for clarity.

Referring to FIGS. 51 and 52 a centrifuging apparatus for the tubes (after mixing) is shown comprising a plurality of cradle means 227 into which the tubes can readily be place and removed from. The cradle means are attached to a vertical drive shaft 229 and have an open top portion 231 for access for the tube. The spin radius 233 can, of course, be widely varied as can the rotational speed of the drive shaft and the structure of the centrifuge and cradle.

In one operational embodiment the filler end of the tube is sealed and said tube centrifuged toward said dispensing end after the mixing operation for about 20 seconds to about 3 minutes at of from about 60 rpm to about 400 rpm at a spin radius of from about 12 in., to about 24 in., for accommodating various length tubes.

Among the many advantages in using the present mixer and color packets, are:

1. Reduce shelf space from about 18 feet for tubes of colored caulk (approx. 5 colors) to approximately 3 feet of shelf space for thousands of individual different colors of caulk;
2. Offer 1000 or more individual colors of caulking from a single base of caulk;
3. Increase the use of silicone caulk (silicone cannot be painted but now with the present invention it can be custom colored);
4. Can offer auto industries and many others a line caulk to be colored;
5. In view of present color packets, no need to mix colored caulk in a factory which typically offers only about 5 colors of caulk in retail stores;
6. Offer epoxy and two-part silicone to be mixed in a single tube;
7. Offer top ten best selling colors of caulk in color packets to be stocked in stores;
8. Retailers can offer custom color packets at a fraction of the cost of buying a quart or gallon of paint to get desired color of caulk;
9. New markets: will have the advantage of offering color packets for painted metal products, counter tops, floor coverings, vinyl siding, the list is endless as well as the market for silicone caulk which is an unpaintable product that now can be custom colored to match any color of paint or other manufactured products;
10. Small hardware stores would be able to stock these color packets to offer colored caulk instead of stocking tubes of pre-packaged colored caulk.

For example, compared to a company which offers 57 different colors of grout and 57 colors of caulk, the present invention allows one to offer 2 bases of caulk and 57 color packets so there would be no wasted caulk and colors would be available immediately.

Figure 54:
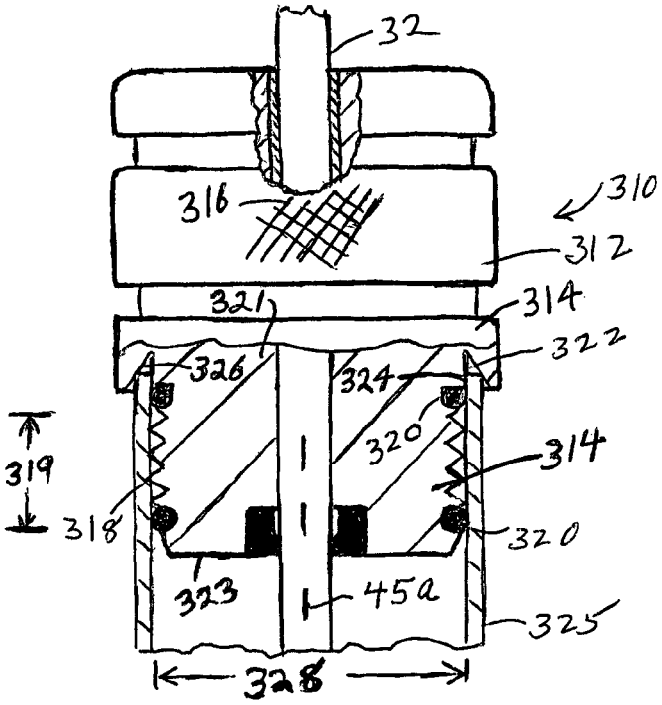
FIG. 54 is a partially cross-sectional view of an alternative and preferred form of mixing head.

Referring to FIG. 54, the circular periphery (top down view) mixer head 310 comprises a hand grip section 312 and a head-to-tube sealing section 314. Any or all outer surface portions of section 312 may be knurled or ribbed or the like as at 316. Section 314 is threaded as at 318, is provided with one or more O-ring or equivalent seals 320, and preferably is formed with a wedge (cam) shaped recess 322. This recess receives the circular wall 324 of the filler end of a caulk tube 325 or the like which is screwed up into the recess by relative rotation of 310 and 325 whereby the angled wall or stop shoulder means 326 of the recess helps to cam inwardly and hold wall 324 into tight engagement with seals 320 and threads 318. In this regard it is preferred that the pitch of threads 318 be from about 7 to about 14 per inch, and for the diameter of the threads and O-ring seals 320 to be slightly, e.g., 0.002-0.005 in., greater than the inside diameter 328 of tube 325 in order to assure a fluid tight seal against the tube wall. Also, preferably the diameter of threaded portion 319 is slightly tapered radially inwardly in the manner of pipe thread from proximal end 321 to distal end 323 of from about 0.002 in., to about 0.010 in. of taper, to more easily accommodate small manufacturing diameter variations of the tube. The thread depth preferably is from about 1/16 in to about 1/8 in.

Referring to FIGS. 55-64 the mixer head generally designated 20(*a*) in a preferred embodiment is substantially circular having a top (hand grasping) section 22(*a*), an intermediate section 24(*a*), a lower seal body section 26(*a*), multiple normally outwardly oriented highly resilient gripping fingers 28(*a*), a clamping ring 30(*a*), and shaft reciprocating axis 45(*a*).

Figures 55, 56, 57, 58, 59, 60, 61, 62, 63:
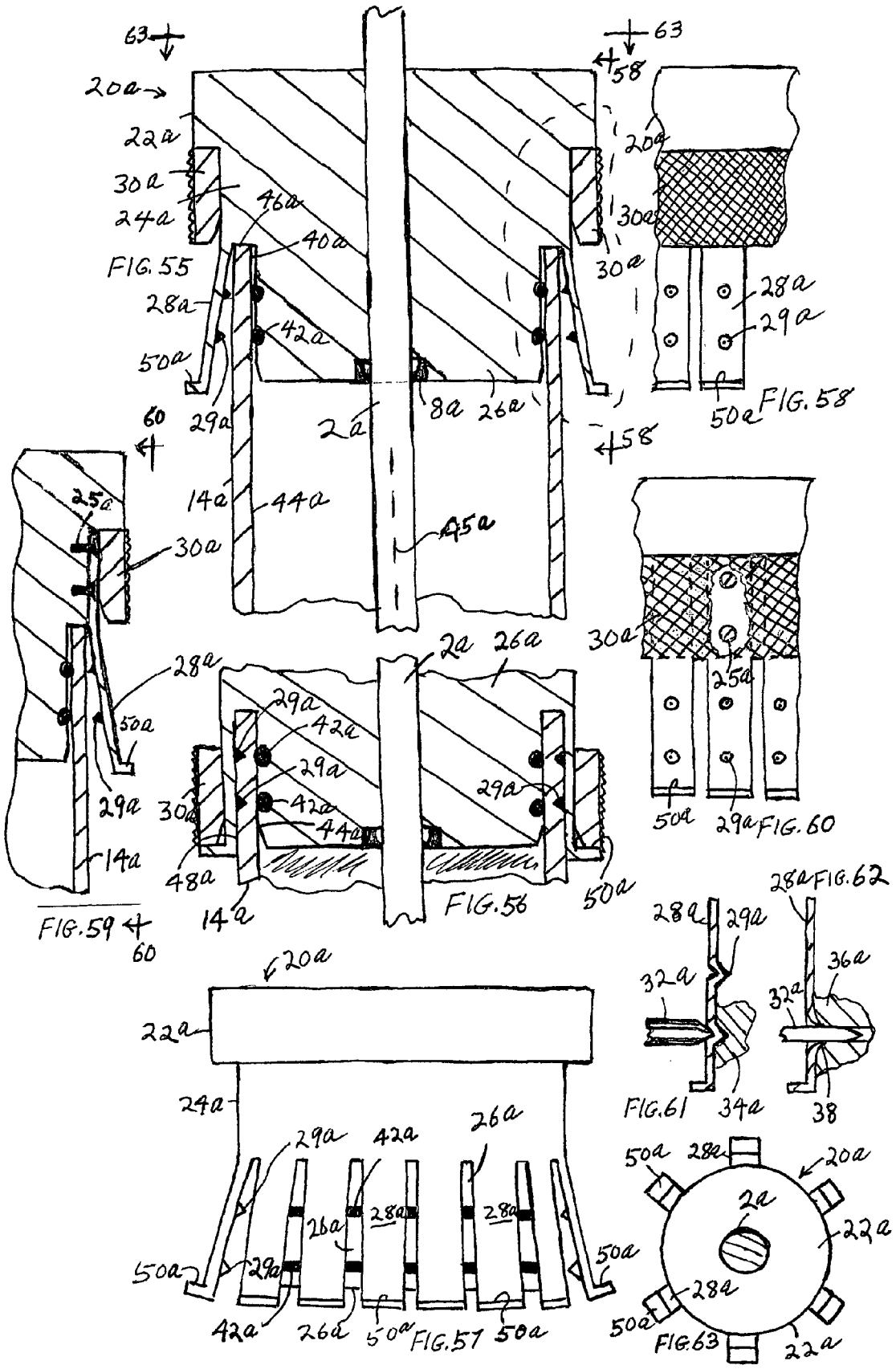
FIG. 55 is a longitudinal cross-sectional view of another form of mixer head in unsealed position on the filler end of a caulk tube.
FIG. 56 is a view as in FIG. with the mixer head sealed onto the filler end.
FIG. 57 is an isolated view of the body portion of the mixer head of FIG. 55.
FIG. 58 is a side view of the mixer head taken alone line 58-58 in FIG. 55.
FIG. 59 is a view as in the encircled dotted line portion of FIG. 55 showing a structural variation of the gripping fingers.
FIG. 60 is a view taken along line 60-60 in FIG. 59 with a portion of the clamping ring broken away for clarity.
FIG. 61 is a cross-sectional view of a gripping finger showing the gripping projections being formed with a center punch.
FIG. 62 shows a variation of forming the gripping points on the gripping fingers.
FIG. 63 is a top view of the present mixer head taken along line 63-63 in FIG.

The gripping fingers 28(*a*) may be of resilient tough material including plastic such as butyrates, polyamide, polyurethane, or the like, or metal, e.g., 26 or 28 gauge spring steel, or the like. As shown in FIG. 61 the gripping points 29(*a*) may be formed by punching with 32(*a*) the finger 28(*a*) into a die 34(*a*). Another method is to punch a hole thru the finger into a die 36(*a*) such that the sharp rim edge 38(*a*) of the hole provides the gripping point.

Fingers 28(*a*) of any workable number, e.g., 6-20, may be formed integrally with head sections 22(*a*), 24(*a*) and 26(*a*) as in a plastic molding operation which forms the entire head. Also, as shown in FIGS. 59 and 60, the individual fingers may be fastened to section 24(*a*) by flat head machine screws 25(*a*) or any equivalent thereof including welding, brazing or adhesive.

Figure 64:
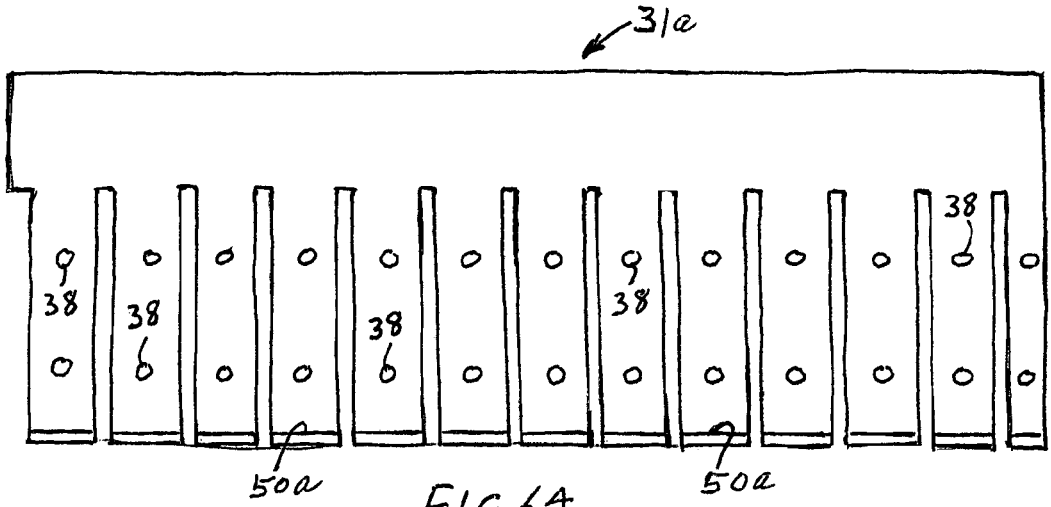
FIG. 64 is a spring steel finger stamping blank.

As shown in FIG. 64 a spring steel sheet blank 31(*a*) for use as in FIGS. 59 and 60 is formed in a single stamping operation including punching holes 38(*a*) as in FIG. 62. This blank is intended to be rolled into a circle and secured to section 24(*a*).

In using the mixer head of FIGS. 55-64, the head (with shaft 2*a* and impeller assembled thereon) is simply hand pushed, seal body section 26(*a*) first, into the filler end 40(*a*) of the caulk tube 14(*a*) to which the colorant has been added whereby O-rings 42(*a*) or equivalent easily but sealingly slide against the inner wall 44(*a*) of the tube until the tube end 46(*a*) abuts section 24(*a*). The knurled clamping ring 30(*a*) is then hand gripped and slidingly forced down over fingers 28(*a*) whereby gripping points such as 29(*a*) or 38(*a*) become impressed (e.g., 2-5 thousandths inch) into the outer wall surface 48(*a*) of tube 14(*a*) as shown in FIG. 56. The downward motion limit of ring 30(*a*) is set by shoulders 50(*a*) on the fingers. With the assembly as shown in FIG. 56, the mixer head 20(*a*) cannot be dislodged from the caulk tube end during the mixing operation by any conceivable normal use of the mixer, and the seal formed between O-ring 42(*a*) and the inner wall 44(*a*) of the tube is extremely tight.

The invention has been described in detail with particular reference to preferred embodiments thereof, but it will be understood that variations and modifications will be effected with the spirit and scope of the invention.

I claim:

1. A method for mixing additive into viscous base material, which base material is contained in a cylindrical tube having a longitudinal axial dimension, a filler end sealed with a removable back plug which has been pushed into said filler end, and further having a dispensing end sealed with a puncturable seal, said tube providing a mixing cavity for said base material and additive, said method comprising; a) removing said back plug from said filler end of said tube, b) adding a measured amount of additive into said cavity thru said filler end to provide a batch for mixing, c) providing a mixing device having a mixer head adapted to be affixed onto said filler end of said tube and hermetically seal said cavity at said filler end, said device further having a mixer shaft having a mixing end portion provided with an apertured impeller affixed to said end portion for reciprocation therewith and adapted to extend into said cavity said shaft further having an operating end portion adapted to extend axially outwardly of said tube and to be engaged by hand or machine for reciprocating said shaft, said shaft being axially reciprocably mounted through a hermetic seal affixed in an aperture provided thru said mixer head; d) inserting said mixing end portion of said shaft with said impeller down into said cavity and into said batch to a desired initial longitudinal position in said cavity; e) affixing said mixer head onto said filler end to hermetically seal said cavity; and f) reciprocating said shaft with said impeller within said cavity between said filler end and said dispensing end whereby said additive is intimately mixed into said base material wherein said filler end of said tube is sealed and said tube is postured with the dispensing end facing generally downwardly and is vibrated after the mixing operation to aid in settling said mass toward said dispensing end whereby de-aeration of said mass is further facilitated.

2. A method for mixing additive into viscous base material, which base material is contained in a cylindrical tube having a longitudinal axial dimension, a filler end sealed with a removable back plug which has been pushed into said filler end, and further having a dispensing end sealed with a puncturable seal, said tube providing a mixing cavity for said base material and additive, said method comprising; a) removing said back plug from said filler end of said tube, b) adding a measured amount of additive into said cavity thru said filler end to provide a batch for mixing, c) providing a mixing device having a mixer head adapted to be affixed onto said filler end of said tube and hermetically seal said cavity at said filler end, said device further having a mixer shaft having a mixing end portion provided with an apertured impeller affixed to said end portion for reciprocation therewith and adapted to extend into said cavity said shaft further having an operating end portion adapted to extend axially outwardly of said tube and to be engaged by hand or machine for reciprocating said shaft, said shaft being axially reciprocably mounted through a hermetic seal affixed in an aperture provided thru said mixer head; d) inserting said mixing end portion of said shaft with said impeller down into said cavity and into said batch to a desired initial longitudinal position in said cavity; e) affixing said mixer head onto said filler end to hermetically seal said cavity; and f) reciprocating said shaft with said impeller within said cavity between said filler end and said dispensing end whereby said additive is intimately mixed into said base material wherein said filler end of said tube is sealed and said tube is centrifuged toward said dispensing end after the mixing operation to aid in settling said mass toward said dispensing end whereby de-aeration of said mass is further facilitated.

3. The method of claim 1 wherein said filler end of said tube is sealed and said tube is postured with the dispensing end facing generally downwardly and is vibrated in a vertical and/or horizontal direction at from about 1/32 in. to about 3/8 in. travel, at between 100 and 600 cycles/minute for between about five seconds and about three minutes, after the mixing operation to aid in settling said mass toward said dispensing end whereby de-aeration of said mass is further facilitated.

4. The method of claim 2 wherein said filler end of said tube is sealed and said tube centrifuged toward said dispensing end after the mixing operation for about 20 seconds to about 3 minutes at of from about 60 rpm to about 400 rpm at a spin radius of from about 12 in. to about 24 in. for accommodating various length tubes, to aid in settling said mass toward said dispensing end whereby de-aeration of said mass is further facilitated.

* * * * *